US008142627B2

(12) United States Patent
Vidaurre Heiremans

(10) Patent No.: US 8,142,627 B2
(45) Date of Patent: Mar. 27, 2012

(54) SYSTEM FOR MONITORING, CONTROL, AND MANAGEMENT OF A PLANT WHERE HYDROMETALLURGICAL ELECTROWINNING AND ELECTROREFINING PROCESSES FOR NON FERROUS METALS

(75) Inventor: Victor Vidaurre Heiremans, Santiago (CL)

(73) Assignee: ANCOR TECMIN, S.A., Santiago (CL)

( * ) Notice: Subject to any disclaimer, the term of this patent is extended or adjusted under 35 U.S.C. 154(b) by 250 days.

(21) Appl. No.: 12/671,509

(22) PCT Filed: Jul. 30, 2008

(86) PCT No.: PCT/EP2008/059963

§ 371 (c)(1),
(2), (4) Date: Jan. 30, 2010

(87) PCT Pub. No.: WO2009/016190

PCT Pub. Date: Feb. 5, 2009

(65) Prior Publication Data

US 2010/0258435 A1 Oct. 14, 2010

(30) Foreign Application Priority Data

Jul. 31, 2007 (CL) ..... 2219-2007

(51) Int. Cl.
*C25B 9/02* (2006.01)
*C25B 9/04* (2006.01)

(52) U.S. Cl. ..... 204/297.01; 204/297.06; 204/279; 204/286.1; 204/288; 204/288.1

(58) Field of Classification Search ..... 204/279, 204/286.1, 288, 288.1, 297.01, 297.06
See application file for complete search history.

(56) References Cited

U.S. PATENT DOCUMENTS 5,645,701 A * 7/1997 Dufresne et al. ..... 204/297.01
7,204,919 B2 * 4/2007 Dufresne ..... 204/279

(Continued)

FOREIGN PATENT DOCUMENTS

CL 02385-1999 10/1999

(Continued)

*Primary Examiner* — Bruce Bell
(74) *Attorney, Agent, or Firm* — Eric A. Hanscom; Todd J. Langford

(57) ABSTRACT

A system to monitor, control and management of a plant where hydrometallurgical processes of electrowinning or electrorefining of non ferrous metals which enables measuring the process variables which comprises: at least one group of electrolytic cells, said cells having means for the collection and transmission of the variables of the process; a plurality of electrodes (5) installed in the interior of each electrolytic cell, making up, alternately, anodes and cathodes of basic cells; a plurality of electrode (5) hanger bars forming, alternately, hanger bars for electrical contact of anodes (20) and hanger bar for electrical contact of cathodes (18); a plurality of support electrical insulators (15) which are positioned in the upper portion of the lateral walls between two adjacent cells; a plurality of electrical bus bars (6) which are fitted on top of each support electrical insulator (15) and underneath the plurality of electrodes (5); a plurality of electrical spacer insulators (16) each spacer insulator (16) having monolithic non contact chairs (17) allowing installation, alternately, of hanger bar of anodes (20) and hanger bar of cathodes (18); a plurality of acid mist collection hoods (7); in which the constituting elements have at least one multifunctional chamber (12) which lodges circuits and/or electronic sensors (11) for measuring process variables which enable to monitor, control and manage the productive process.

59 Claims, 12 Drawing Sheets

U.S. PATENT DOCUMENTS

| | | | | |
|---|---|---|---|---|
| 7,223,324 | B2 * | 5/2007 | Dufresne | 204/279 |
| 2005/0121319 | A1 * | 6/2005 | Dufresne | 204/297.1 |
| 2005/0217999 | A1 | 10/2005 | You | |
| 2005/0284753 | A1 * | 12/2005 | Dufresne | 204/288 |
| 2010/0065423 | A1 * | 3/2010 | Dufresne | 204/297.01 |
| 2011/0132753 | A1 * | 6/2011 | Dufresne | 204/297.01 |

FOREIGN PATENT DOCUMENTS

| | | |
|---|---|---|
| CL | 00527-2001 | 3/2001 |
| CL | 02335-2003 | 11/2003 |
| CL | 02789-2003 | 12/2003 |
| CL | 01057-2004 | 5/2004 |
| CL | 00727-2006 | 3/2006 |

* cited by examiner

SYSTEM FOR MONITORING, CONTROL, AND MANAGEMENT OF A PLANT WHERE HYDROMETALLURGICAL ELECTROWINNING AND ELECTROREFINING PROCESSES FOR NON FERROUS METALS

The present invention relates to a system for monitoring, control and management of a plant where hydrometallurgical electrowinning and electrorefining processes for non ferrous metals are conducted which enables to measure process variables, including the elements forming said system.

A system for monitoring, control and management of a plant where hydrometallurgical electrowinning and electrorefining non ferrous metals are provided which enable to measure process variables, which comprises: at least one group of electrolytic cells said cells having means for the collection and transmission of the variables of the process; a plurality of electrodes installed in the interior of each electrolytic cell, making up, alternately, anodes and cathodes of basic cells; a plurality of electrode hanger bars forming, alternately, hanger bars for electrical contact of anodes and hanger bar for electrical contact of cathodes; a plurality of support electrical insulators which are positioned in the upper portion of the lateral walls between two adjacent cells; a plurality of electrical bus bars which are fitted on top of each support electrical insulator and underneath the plurality of electrodes; a plurality of electrical spacer insulators each spacer insulator having monolithic non contact chairs allowing installation, alternately, of hanger bar of anodes and hanger bar of cathodes; a plurality of acid mist collection hoods in which the constituting elements have at least one multifunctional chamber which lodges circuits and/or electronic sensors for measuring process variables which enable to monitor, control and manage the productive process.

BACKGROUND OF THE INVENTION

Generically the object of hydrometallurgical electrodeposition processes is the physical transfer of positively charged metallic ions from the electrolyte which contains them dissolved in a given concentration, to the submerged surfaces of negative charged energized cathodes. The basic electrolytic cells is composed of two energized electrodes—typically flat conducting plates, hanging parallel at a given distance in the electrolyte—an anode of positive charge and a cathode of negative charge—which generate respective chemical reactions—oxidizing at the anode and reducing at the cathode. Upon applying a low voltage, continuous current to the anode, the anions (ions of negative charge) present in the electrolyte migrate to the anode, while the cations (metallic ions positively charged) migrate the cathode where they deposit on the cathodic surface. The running of the process obeys Faraday's laws, whereby the chemical reaction is proportional to the flow of electrical charges on the plates of the electrodes—measured in amperes per unit of electrode surfaces—and referred to as current density. The current density is the key parameter that characterizes both the electrodeposition of metal in solution and its distribution on the cathode, as well as the efficiency of electrical current usage. The maximum electric efficiency is obtained operating the process at the maximum current density compatible with the continuity of metallic electrodeposition at the given sustained, acceptable level of quality. On the other hand, the current density is also limited in practice by the maximum diffusion of the metallic ions in said electrolyte at its given temperature. Actually, at a higher current density than that diffusion limit the stocks of metallic ions randomly distributed in the layers of electrolyte close to the cathode plates become exhausted, according to a concentration gradient decreasing towards the cathode plates, and therefore, the instantaneous availability for electrodeposition on the plate became insufficient to sustain indefinitely either the continuity of the process or the resulting quality of the metallic deposit.

To better understand the problems associated with hydrometallurgical electrodeposition processes as industrial scale, the electrolytic cells can be visualized as being composed of the sum of individual basic electrolytic cells—one after the other, disposed as productive units in series—physically filling the internal volume of each industrial electrolytic cell container. The electrochemical reactions and the physicochemical phenomena of diffusion of metallic ions between each pair of plates anode/cathode facing each other in each basic cell is essentially similar, although not identical in magnitude in time, each basic cell in an industrial electrolytic cell behaves individually in accordance with it owns electrical, chemical, hydrodynamic given variables in its immediate surrounding, and for that reason, the result of metallic quality electrodeposition varies from cathode to cathode from each electrolytic cell at harvest. In order to improve the result at the level of an industrial cell it becomes essential to monitor and control the instantaneous variables of the process in each basic cell in real time.

For the continuous running of the industrial process in time, the concentration of metallic ions in the electrolyte within each basic cell must be maintained stable, within a given range. This condition is achieved by continuously feeding an appropriate flow of fresh electrolyte of high metallic concentration through one of the cell ends, allowing it to circulate in contact with the cathodic surface of the basic cells disposed in series, with the corresponding simultaneous discharge of the same flow of spent electrolyte or lower metallic concentration through the opposite wall or overflow side of the industrial cell.

While the electrochemical processes of electrowinning of non ferrous metals are run in the basic electrolytic cells, on the plate of the anode—manufactured typically with lead alloys which are insoluble in electrolyte good electrical conductors, structurally rigid and resistant to acid attack—some chemical substances are detached or generated, which are insoluble in electrolyte and of higher density than the electrolyte, and deposit on the bottoms of the cell containers as anodic sludge. The accumulation of anodic sludge requires empting the cell containers for periodic cleaning of the bottoms. In the case of copper, de-sludging prevents the hydrodynamic flow of the electrolyte close to the upper level of the sludge accumulated on the bottom from entraining the lighter sludge particles and mixing them in the trajectory of metallic ions flowing towards the cathode plates, introducing, in this manner, foreign particles into the pure metallic copper deposit required. In the case of the electrorefining processes, particularly copper, the cast impure copper anodes are soluble in the electrolyte, and contained impurities and traces of noble metals such as Au, Pt, Co and exotic metals such as Rhenium, etc, which by virtue of their extremely high value need to be recovered from anodic sludge upon its discharge from the containers, in subsequent extractions.

To obtain homogenous and uniform metal deposits in each cathode of each basic cell during production cycle of the processes of the electrowinning and electrorefining of non ferrous metals, it is essential to establish and maintain given current density as uniform as possible in the entire cathodic surfaces, and that condition requires maintaining simultaneously perfect parallelisms with the given uniform separation between all the point in the surfaces facing each other in the electrode plates, optimal electrical contact of each electrode with each electrical busbar and control of the temperature in each one of these contacts. To succeed in maintaining optimal electrical contact in time, it is indispensable to rely on the fact that the hanger bars of the electrodes and there respective plates will be in perfect geometrical condition, and maintain the electrical contact of the hanger bars with the busbar uninterrupted and free from interferences through permanent, frequent and thorough cleaning of the critical areas of these electrical contacts, with abundant washing with demineralized water.

At present, to reach the nominal capacity of metal in an industrial electrowinning or electrorefining plant of non ferrous metals, the electrolytic cell containers of the respective processes of hydrometallurgical electrodeposition are disposed in groups of cells forming banks or sections, each one composed of given number of containers, all uniformly dimensioned to install in their interior a given number of electrode, anodes and in particular cathodes, on whose surfaces the ions of metals will be deposited.

On the other hand, the design of the plant, the volume flow of the hydraulic electrolyte circuit and the power of the continuous current rectifier in the electrical system to energize the cells in their banks are dimensioned so as to obtain the nominal capacity of metal electrodeposition assuming sustained application during the entire operational cycle, of given current intensity per unit of cathodic surfaces installed in the containers of the cells. As electrodeposition is a process of continuous aggregation in time of metallic ions on the cathodic surface energized inside the cells, and thereby, the application of current from the time of immersion of the empty cathodes until the harvest of metal from the full cathodes—is maintained according to the real evolution in time of the variables of the specific process of the electrodeposition in each cells during the cycle—until reaching a convenient given average weight of metal accumulated in the cathodes. Essentially, the operational management of the process of electrodeposition in each basic cell has as an objective permanent and stable management of three fundamental parameters in electrodeposition, in such a way as to maintain them in optimum, sustained equilibrium from the beginning to the end of each operational cycle: the volume flow of electrolyte at the given temperature at the given concentration of metal in solution, the total available anodic and cathodic surface effectively energized in the cell, and the given current density uniformly applied to those energized cathodic surfaces.

In industry, at present none of these parameters and neither their instantaneous evolution in time is measured simultaneously in each cell and in real time.

To form the bank, the containers are installed adjacent to each other with their longitudinal lateral wall close together, in such a way that the respective longitudinal axis are parallel and positioned at right angles with respect to the longitudinal axis of the plant building. After connecting the respective hydraulic and electrical circuits with their equipment, the containers grouped in banks become banks of operational electrolytic cells in the plant. The banks are disposed forming two or more parallel lines along the longitudinal direction of the plant covering its surface.

Traveling cranes mounted transverse above the cell banks run in the longitudinal sense of the plant covering its surface for the transport, manipulation, insertion of the empty cathode blanks in any cell, and also for the removal, transport and manipulation of the harvested full cathodes from each cell at the beginning at the end, respectively, of each productive cycle. Industrially, the banks of cells are started and operated in such a manner that the harvests of cathodes from the respective cells are sequenced in time to maximize the use of the traveling cranes.

At present, in the electrolytic cells of industrial hydrometallurgical electrodeposition processes of electrowinning and refining of non ferrous metals, the electrodes are energized with continuous current of high amperage and low voltage, by means of direct mechanical contacts with the electrical busbars, which are typically of machined, high purity copper. The electrical busbars are disposed longitudinally parallel between each other directly supported on electrical insulators installed over the upper edges of the lateral walls of adjacent cells in their bank. The electrodes are laminar, flat plate electrical conductors which hang transverse to the cells by means of hanger bars that project outwards from the upper vertices of the plates, made of solid copper or steel shapes with a conducting facing or lining for efficient electrical contact with the busbar. The electrodes are installed transverse to the longitudinal axis of the cells, parallel and uniformly spaced from each other, anodes and cathodes intercalated, supported on spacer electrical insulators which maintain them equidistant. The length of the electrode hanger bar is supplied to suit the width of each cell so as to reach and contact the electrical busbars disposed at both sides of each cell.

To force the passage of continuous electrical current from the anode to the cathode hanging immersed in the electrolyte solution with ions of a non ferrous metal, the points of electrical contact between the ends of each electrode hanger bar with the electric current busbar on the lateral walls of the electrolytic cells are disposed alternated. In effect, one end of the hanger bar of the first anode is in contact with the first electrical busbar, while the other end of the hanger bar of the same anode must remain electrically insulated to positively not make contact with the second busbar. The second electrical busbar must make contact with the hanger bar of the next adjacent cathode, at the opposite end, immediately contiguous to the contact of the hanger bar of the first anode, and must remain electrically isolated from the first busbar. Schematically, in the electrical circuit of the electrolytic processes of interest, the electrical current enters the electrolyte from the electric busbar typically through end in contact with the hanger bar of the first anode, down through the plate of the submerged anode, then crossing electrically the ionized solution of electrolyte and making contact with the submerged plate of the next adjacent cathode, then returning from electrolyte to the second electrical busbar through the hanger bar of the cathode in contact with it. In the electrowinning processes of non ferrous metals where the anodes are insoluble, the unit electrical scheme for "n" anodes installed in each cell and their respective "n−1" cathodes intercalated in between the anodes, assure that both faces of the cathodic plate in each basic cell are supplied with metallic ions from the respective adjacent anodes. In the processes of electrorefining, where the anodes are made of impure metal and soluble in the electrolyte, the unit electrical scheme is repeated for "n" cathodes installed with the respective "n−1" anodes intercalated in between the cathodes.

Typically, for electrowinning of non ferrous metal, especially copper, solutions of the metal and sulfuric acid are utilized as electrolytes, in volumes flows that are related with their temperature, and principally, with the industrial current density imposed to the electrodes. In the case of copper, typically the volume flows are in the range of 14 to 30 m3/hr of electrolyte at 45-50° C. for current densities between 250 and 500 amperes per square meter, enabling to electrodeposit metallic copper at a rate between 6-10 gr/minute per square meter of cathodic surface.

During the production cycle in copper electrowinning, specially when the cells are operating with high flows, high electrolyte temperature and high current density to the electrodes, abundant oxygen is generated at the anode and some hydrogen at the cathode of each basic cell, gases which climb and emerge from the electrolyte surface into the plant atmosphere, carrying significant volumes of sulfuric acid as acid mist which is very toxic to human health. To comply with the admissible limits of contaminant substances in suspension in industrial plants indicated by the current environmental legislation, copper electrowinning cells of the latest design are operated covered and are equipped with hoods or equivalent collector devices for the collection, control and management of acid mist. The anti-mist devices are installed longitudinally supported on top of the electrode hanger bars, or alternatively, over the upper edges of the frontal walls of each cell, so that their inferior footprint perimeter remain above the electrodes. To harvest full cathodes at the end of the production cycle in each cell, the hood or equivalent anti mist capture device must be removed with the crane, and reinstalled after reloading the cell with empty cathode blanks before restarting the next production cycle.

In the electrorefining processes of non ferrous metal, especially copper, the impure metal to be refined is first melted and molded in laminar plates which are monolithic with their hanger, and said soluble plates positioned in the electrolyte as anodes in the electrolytic cell. The electrolyte also contains sulfuric acid and copper in solution, just as in the processes of electrowinning just described. In the copper electrorefining processes generally the volume flows of electrolyte at 62-65° C. vary between 14 to 18 $m^3/h$ (and current densities between 250 to 320 amperes per square meter), and are lower compared to the corresponding values in copper electrowinning. The lower flows and current densities generate much smaller volumes of acid mist than in electrowinning, whereby copper electrorefining plants generally are able to comply with environmental legislation through good ventilation without need of special collector hoods.

In the industrial operation of electrolytic cells, electrical short circuits are occasionally produced by direct contact of the laminar plates of the electrode, which are of particular relevance by the problem they impose by localized high temperatures, above 500° C., generated by high amperage currents in the electrical contacts of the hanger bars and electrical busbars. In effect, prior art electrical insulator polymer composite materials used in the areas of non contact supports of electrode hanger bars with electrical busbar are formulated with high contents of binding resin and with global contents inorganic reinforcements in general insufficient, and moreover of design, and shapes generally inappropriate. Starting from temperatures above 90-100° C., the thermal expansion of state of the art polymer composite material used in spacer insulators, specially structurally reinforced in the longitudinal sense with pultruded reinforcement bars (whose coefficient of lineal expansion is not compatible with the coefficient of lineal expansion of the polymer composite material of the electrical insulator which they reinforce) begin to bend and thereby start loosing their dimensional stability. This dimensional and geometrical instability of the insulator causes displacements in the positions of the electrodes, thereby favoring the continuity of short circuit initiated, prolonging them in time; and thereby, increasing the probability of generating additional short circuits upon carbonization of the binding resin of the insulators at the resulting high temperatures. Heat disintegrates the resin binder of the insulator material and thereby electrical insulation can collapse, resulting in fires or other accidents and irreversible damages. Notwithstanding the material deficiency commented, the use of pultruded bars in structural reinforcement of electrical insulator of polymer composite material for electrolytic cells continues widespread in the present art as can be reviewed in U.S. Pat. Nos. 4,213,842; 5,645,701; 7,204,919. It is indispensable for the industry to have available electrical insulators for electrolytic cells specifically constructed for better tolerance to occasional high temperature service, and of course, with sufficient thermal resistance to survive high amperage prolonged short circuits, and moreover, also internally structured for sufficient dimensional stability to maintain their geometry during such severe thermal episodes.

With the aforementioned in terms of absence of means to measure process variables and some basic equipment deficiencies, it becomes evident the truly overwhelming complexity of achieving equilibriums between electrical, thermal, physical, chemical, metallurgical, and hydrodynamic flow variables in the vicinity of immersed cathodes in each basic cell. The operational problem does not only consist in achieving satisfactory equilibriums with many changing variables but in the much bigger challenge of maintaining them substantially stable in time, from the beginning to the last instant of each production cycle, in each electrode of each industrial cell. In the present art, maintaining such equilibrium in the actual electrolytic cell is dictated by global empirical experience of the operators of each plant; said target equilibriums originally established and verified as suitable for the changing characteristics of Plant specific electrolytes. The correction or adjustment of variables is not as frequent a practice as is really required, and therefore, it is not surprising that the levels of electrodeposition performance and the usage of electrical energy observed in the industry at present remain quite below the possible theoretical optimum.

Perhaps the biggest technical problem at present is that in the basic electrolytic cells which conform the industrial cell, the instantaneous state of the variables of the electrolyte and the intensity and continuity of the electrical current to the process of the electrodeposition is not only not systematically measured, monitored, registered nor controlled in real time, but neither are instantaneous deviations or their trend in time diagnosed nor opportunely corrected with respect to their optimum. Such ability to measure, control and manage in real time is indispensable to optimize both the quality as well as the hydrometallurgical productivity of the electrodeposition processes in each basic cell, harvest after harvest, since not having opportunity to make adjustments in controlling the effectiveness, it is impossible to systematically assure before hand, the quantity and quality of the metal of the electrodeposit metal in the harvest cathode of the corresponding industrial cell at the end of each production cycle; and neither to improve consistently the global electrical performance with respect to present standards. The above problem can only be solved through technical management in real time, monitoring and managing simultaneously the unit behavior of each electrode in the basic electrolytic cell, in each industrial cell in the bank of cells and, certainly, also in the whole of industrial cells in the plant.

It is pertinent to point out that at present, for example, even for the experienced operator of electrowinning copper plants of the latest technologies as recently built in Chile in 2006, the lack of segregated information of the run cycle in real time, especially of the behavior of each anode and each cathode, per cell and per bank, prevents or at least hampers the controlled introduction of new hydrometallurgical technologies developed and in existence to increase electrolytic productivity and quality of the metal deposit. In fact, some operational technologies exist that are aimed to revert the primitive state of the present art of industrial plant operation management of processes of hydrometallurgical electrodeposition of non ferrous metal, such as Chilean Patent Application N° 01057-2004 "Method for the evaluation and control of operational parameters of electrowinning or electrorefining of non ferrous metal plant" and the Patent Application N° 02335-2003 "Support device to identify steel cathodes", both assigned to 3M INNOVATIVE PROPERTY Co. USA. The contents and scopes of these patent applications although pointing in the correct direction, fall short, are partial and insufficient to supply effective means duly linked together to materialize segregated, measurements of variables by electrode in real time, at the basic cell level of electrolytic cells, industrial cells, banks of cells and of the whole of cells in a plant. Said condition appears as an essential base to opportunely detect any unfavorable deviations—at the very instant in which they start—and to correct them in such a way as to be able to maintain as normal the complex equilibriums of the variables of the processes of interest, at their optimum levels from the beginning to the end of each productive cycle in each and every cell.

Paradoxically, the electronic technology for measurement some parameters of the process in the basic electrolytic cell in real time also exist, for example, the vital measurement of the electrical current circulating in each cathode of the basic cell in a permanent manner in a real time, and the transmission of the data read from each for centralized computational management, which was conclusively and very successfully demonstrated at pilot industrial level in 2002. Moreover, the electronic circuit for instantaneous capture of the continuous current effectively circulating in the electrode of the basic cell in real time, its coding to electronic signals, its accumulation and transmission for computational management in a remote centralized system in the plant are claimed already in the Chilean Patent Application N° 2789-2003. However the above mentioned technology to this date has not been applied industrially to the processes of interest in the industrial electrolytic cells in reference, fundamentally by lack of means that would allow bringing said electronic circuits sufficiently close to the electrodes in a stable manner, so as to insure ongoing correct operation. Friendly, non invasive, non disturbing means to the operational routines of the cells in the plant were lacking, as in fact occurred in 2002 pilot plant experience. To become industrially practical the means that are still lacking—and now are desired to patent—must be designed, adapted, concatenated and remain in convenient fixed positions in each basic cell, and at the same time, remain adequately protected to routinely operate in conjunction with industrial electrolytic cells.

With respect to electrical insulators, for properly energized, insulated and spaced electrodes in electrolytic cells, since Patent Application N° 2385-1999 they have not been improved sufficiently. It has neither been incorporated in generalized fashion to the operational practices of industrial plants of hydrometallurgical electrodeposition, several other concepts and innovative technologies that improve metallurgical productivity and quality of metallic deposit with decreased usage of electrical energy. In fact, it has not been massively introduced, for example, concatenated means in the cell for decontamination of acid mist, increasing thermal performance, productivity and quality of the processes of electrowinning and electrorefining of non ferrous metals, taught in Patent Application N° 527-2001, nor other more recent to increase productivity by improving the diffusion of metallic ions with controlled agitation of electrolyte as taught in Patent Application N° 727-06. The delay in the introduction of innovative technology probably is due to attendant operational difficulties and certainly, in the present art that prevails in the hydrometallurgical copper industry of conservative operational caution, privileging what is prudent and demonstrated effective to produce stable volumes with assurance, over risking operational instabilities and uncertainty involved in the introduction of innovations in order to obtain promised benefits, which appear very difficult challenges to materialize not worth the risks.

The next step in the progress of the industry definitively points to the development of industrial operational protocols based on measurement of the variables and effective correction in real time of the problems of the processes of hydrometallurgical electrodeposition in the basic electrolytic cell—which is the real productive unit requiring control—as it should be and as is normal to expect in the 21st century of any massive industrial process of similar importance and complexity.

SUMMARY OF THE INVENTION

The present invention provides a system for monitoring, control and operational management of a plant in which hydrometallurgical industrial processes of electrowinning or electrorefining of non ferrous metals are conducted in electrolytic cells, as well as the elements composing such system. More specifically, the present invention refers to a system for monitoring, control and operational management of the variables involved in such processes, and whose constituent elements to measure variables, transform them into electrical signals and transmit them, are designed to operate associated with the electrolytic cells and their accessories in which such processes are conducted, where said system is characterized by including internal cavities or external chambers appropriate to lodge circuits and/or sensors that serve as means for identification of each electrode in each position in each cell, and for continuous electronic measurement of the instantaneous state in real time, both of the evolution of the variables of the process as well as of the weight of metal electrodeposited in each cathode, permitting identification, measurement, and monitoring and remote electronic control for optimized management of the variables of the electrowinning process, broken down by electrode, by cell, by cell banks and overall cells in the plant, for the purpose of the maximizing continuity of electro deposition and, simultaneously, quality of the metal deposit in each cathode with minimum usage of electrical energy.

A first object of the present invention is to provide a system which will allow to monitor, control and manage the variables of hydrometallurgical processes of electrodeposition in electrolytic cells in a plant where such processes of hydrometallurgical electrowinning and electrorefining of non ferrous metal are conducted, by providing monolithic internal cavities or external chambers in the containers of the respective industrial electrolytic cell, in their electrodes, in their electrical insulators and/or in their antiacid mist hoods for the friendly lodging, not invasive, nor disturbing of the operational routines of the cells in the plant, of cables, one or more electronic sensor circuits or other means that allow simultaneously measuring all the variables of the processes, transforming them in electronic signals in real time and transmitting them from the different cavities or chambers of capture to a remote control area in the plant, in such a way that said signals can be coded as data of the instantaneous state of the variables measured, permitting their remote centralized control and management for optimized evolution of the processes of metallic electrodeposition conducted in side of said cells, during each productive cycle.

A second object of the present invention is to provide electrical insulators for the system which will allow to monitor, control and management of a plant where hydrometallurgical electrowinning and electrorefining of non ferrous metals in electrolytic cells are conducted, where such electrical insulator will allow electrical feeding and highly stable spacing of the electrodes, with a new monolithic construction that substitutes pultruded reinforcing bars by high resistance, hollow structural shapes of polymer composite materials of low thermal deformation, which in their interior provide multifunctional cavities with adequate means for lodging, arrangement and simultaneous operation of electrical cables, one or more electronic sensor circuits or other similar means in their interior, which allow to measure variables of the process in real time, transforming them in electronic signals and transmitting them from the different cavities in the electrical insulators of the cells to an area or control of the plant.

A third object of the present invention is to provide electrical insulators for the system which will allow to monitor, control and management of a plant where hydrometallurgical electrowinning and electrorefining of non ferrous metal in electrolytic cells are conducted, in which the positions of non contact of the hanger bars of the cathodes are provided by one or more multifunctional cavities with means for lodging, arrangement and operation of one or more electronic sensor circuits interconnected with load cells or other means for the measurement in real time of the instantaneous weight of metal electrodeposited in each cathode.

A fourth object of the present invention is to provide electrical insulators in the cells for the system which will allow to monitor, control and management of a plant where hydrometallurgical electrowinning and electrorefining of non ferrous metals in electrolytic cells are conducted, where such insulators are provided with one or more monolithic cavities containing within hollow structural shapes of translucent polymer composite materials to allow visual detection of luminous signals, emitted from the interior of the insulators, from the electronic circuits lodged in such cavities, such signals to indicate deviations that exceed a given set limit tolerance for the one or more variables measured by the one or more electronic sensor circuits lodged within the insulator.

A fifth object of the present invention is to provide electrical insulators for the system which will allow to monitor, control and management of a plant where hydrometallurgical electrowinning and electrorefining of non ferrous metals in electrolytic cells are conducted, where said insulators are provided with multifunctional cavities in their interior as means to feed and disperse controlled volumes of cold fluids at high pressure for the cleaning by washing of each contact of the electrode hanger bars with the electrical busbar and/or for the refrigeration of such contacts with the purpose of mitigating thermal shocks of the copper elements in direct contact during short circuits events.

A sixth object of the present invention is to provide hanger bars for electrodes to form an anode or a cathode in the electrolytic cells, suitable for the system which will allow to monitor, control and management of a plant where hydrometallurgical electrowinning and electrorefining of non ferrous metals in electrolytic cells are conducted, where said hanger bar is supplied with one multifunctional cavity designed with aptitude to lodge and electronic sensor or circuit positioned in such a way so as to allow identifying each cathode and anode, their relative positions within each industrial electrolytic cell in the plant, and measure temperature in each hanger bar.

A seventh object of the present invention is to provide an acid mist collection hood in the electrolytic cell for the system which will allow to monitor, control and management of a plant where hydrometallurgical electrowinning and electrorefining of non ferrous metals in electrolytic cells are conducted, where said hood is provided with one or more multifunctional chambers to lodge one or more sensors and/or circuits that enable measuring and monitoring in time the level of sulfuric acid concentration in the acid mist produced in the electrowinning process, the sense of flow and amperage of the electric current circulating in electrode each hanger bar in real time while energized.

An eight object of the present invention is to collect and register data captured by the circuits and/or sensors of the different elements which compose the system in real time, to obtain and represent the instantaneous state of the variables of the process and their evolution in time during each productive cycle, signaling with opportune warnings the deviation of a variable with respect to limit imposed to initiate corrective action, and thus maintain stable equilibrium among the variables at their optimum level, harvest after harvest of metal, in each basic cell, in each industrial cell, in each bank of cells and also at the level of the whole of cells in the plant, and through such operational management in real time, eventually succeed in achieving positive improvements in both quality of metal electrodeposited and global usage indexes of electric power and of other items, and productivity in the hydrometallurgical processes of electrodeposition of non ferrous metals conducted in electrolytic cell. This knowledge will eventually allow the construction of generic computerized models to optimize specific processes using the variables of each plant, and also eventually, will lead to plant automation with optimized management of the processes of electrodeposition through computers.

The circuit and/or sensor utilized in this system to monitor, control and management are described only functionally to illustrate the generic requirements of installation, arrangement and operation impose on the design, material formulations and provision of multifunctional internal cavities and external chambers, such as hollow structural shapes and electric insulators of polymer composite material which are claimed. The multifunctional internal cavities and external chambers of the present invention for the lodging, arrangement and operation of the sensor circuits can all be designed and incorporated into the electrical insulators, to the electrodes, to the acid mist hoods or to the containers themselves, simultaneously or separately, as required by the objects desired of identifying, measuring, monitoring, and controlling all the process variables that determine the global results of hydrometallurgical electrodeposition of non ferrous metals, including key variables related to the electrolyte within each container of each electrolytic cell which are not measured at present, as for example, monitoring the correct height of electrodeposition on the surface of cathodes and temperatures of the electrolyte near front walls with the electrodes immersed in the cells, detecting the presence objectionable organic and inorganic impurities which contaminate the electrolyte and are entrained by it upon feeding the cell, height of the anodic sludge accumulated on the bottom of the container, etc.

Having said the above, the description and drawings which are presented must be interpreted as illustrative for better understanding of the contents, scope and usefulness of the cavities and chambers in the cells and their accessories which are provided to dramatically improve the capacity to manage the processes of hydrometallurgical electrodeposition.

BRIEF DESCRIPTION OF THE DRAWINGS

To illustrate more precisely the characteristics of the new multifunctional cavities and chambers for lodging, arrangement and operation of several generic electrical sensors that can be utilized for optimization in real time of processes variables in the of hydrometallurgy electrodeposition conducted in industrial electrolytic cells will be described with reference to the drawings that constitute and integral part of the present invention, in which.

DETAILED DESCRIPTION OF PARTICULAR EMBODIMENTS

The present invention provides a system to monitor, control and operation management of a plant where industrial hydrometallurgical processes of electrowinning or electrorefining of non ferrous metals in electrolytic cells are conducted, as well as the constituent elements of such system. More specifically, the present invention refers to a system to monitor, control and operation management of the variables of said processes, and where its constituent elements to measure variables, transform them into electronic signals and transmitting same are designed to operate associated inside the electrolytic cells and their accessories in which said processes are conducted, and characterized by including internal cavities or external chambers suited to lodge circuits and/or sensors that serve as means for identification of each electrode and its position in each cell, for continuous electronic measurement in real time of the instantaneous state and the evolution in time of the variables of the process, as well as of the metal electrodeposited in each cathode, thus enabling identification, measurement and monitoring of deviations and remote computer control for optimized management of the variables of the electrodeposition process segregated by electrode, by cell, by bank of cells and overall cells as a whole in a plant, to simultaneously maximize both the continuity of electrodeposition process and the quality of metal deposit in each cathode with minimum electrical energy used.

Figure 1:
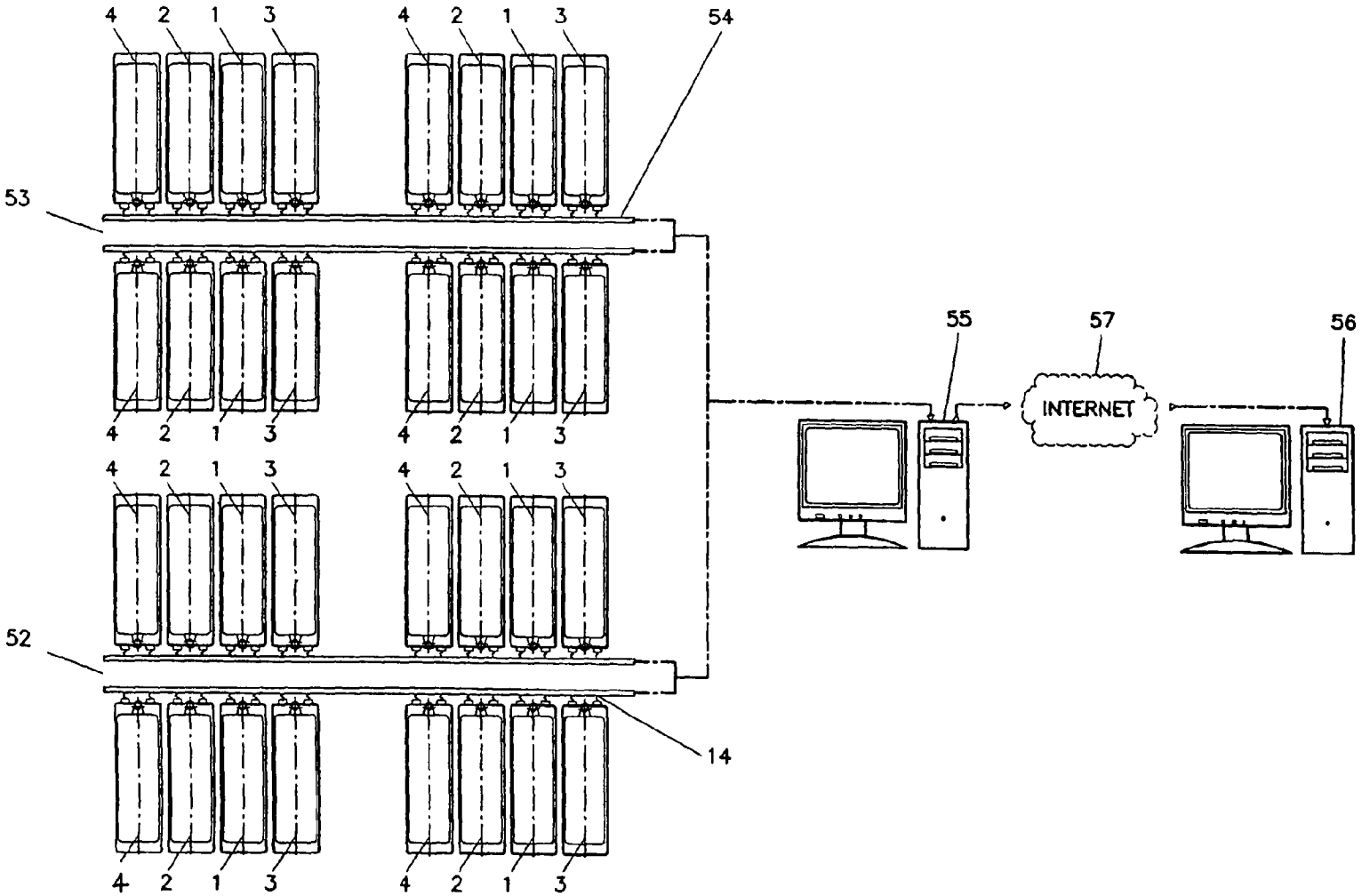
FIG. 1 shows a diagram of the overall system with its elements interconnected in such way that process variables measured and transformed by the circuits and/or sensors lodged in the cell elements, become coded in a set of data representing the instantaneous state of the variables measured, allowing to monitor, control and remote centralized management of the evolution of the hydrometallurgical electrodeposition processes conducted inside industrial electrolytic cells during each production cycle.

Referring to FIG. 1, a first plant 52 is shown formed by 2 banks or 4 cells each 1, 2, 3, 4, and each bank of cells within the plant 52 is provided with sensors which are connected by cable 14 for transmission of signals to a remote control computer 55. A second plant 53 also formed by 2 banks of 4 cells 1, 2, 3, 4 shown a FIG. 1, where each group of cells inside plant 53 it has sensors which are connected by a bus a cable 14 for transmission of signals to the same control computer 55.

The data measured and transformed into electronic signals by the circuits and/or sensors are sent through an internal network 54 to the control computer 55. Said computer could be accessed through a local network, external network or public, for example internet 57 from an external computer 56 from any where in the world, allowing knowing the state of the global processes of the two electrowinning plants in real time, and even of each basic cell in each of electrolytic cell container, from places very remote to the each plant.

Figure 2:
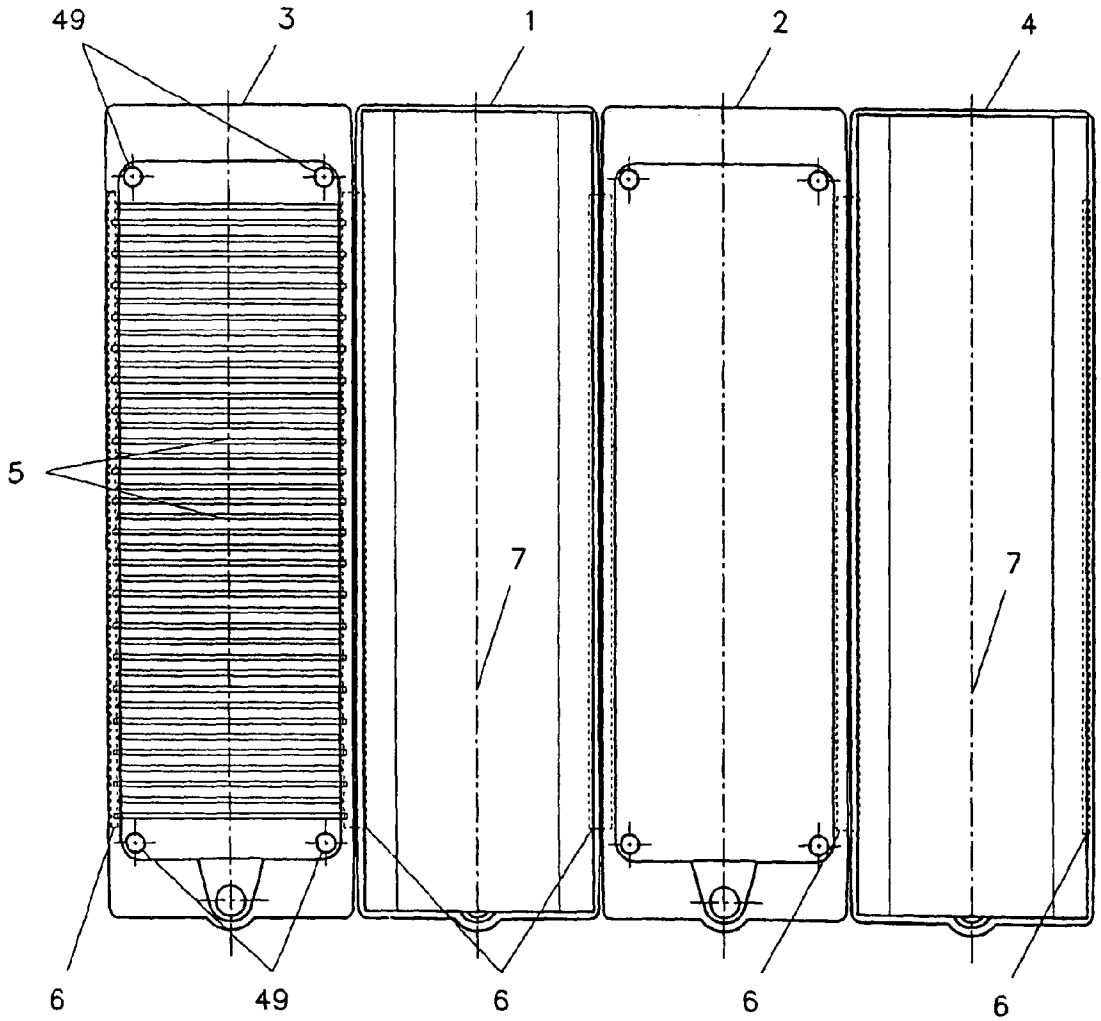
FIG. 2 is a top view of a typical bank arrangement formed by four electrolytic cells, with their electrodes, electrical busbars and insulators, and acid mist collection hoods.
Figure 3:
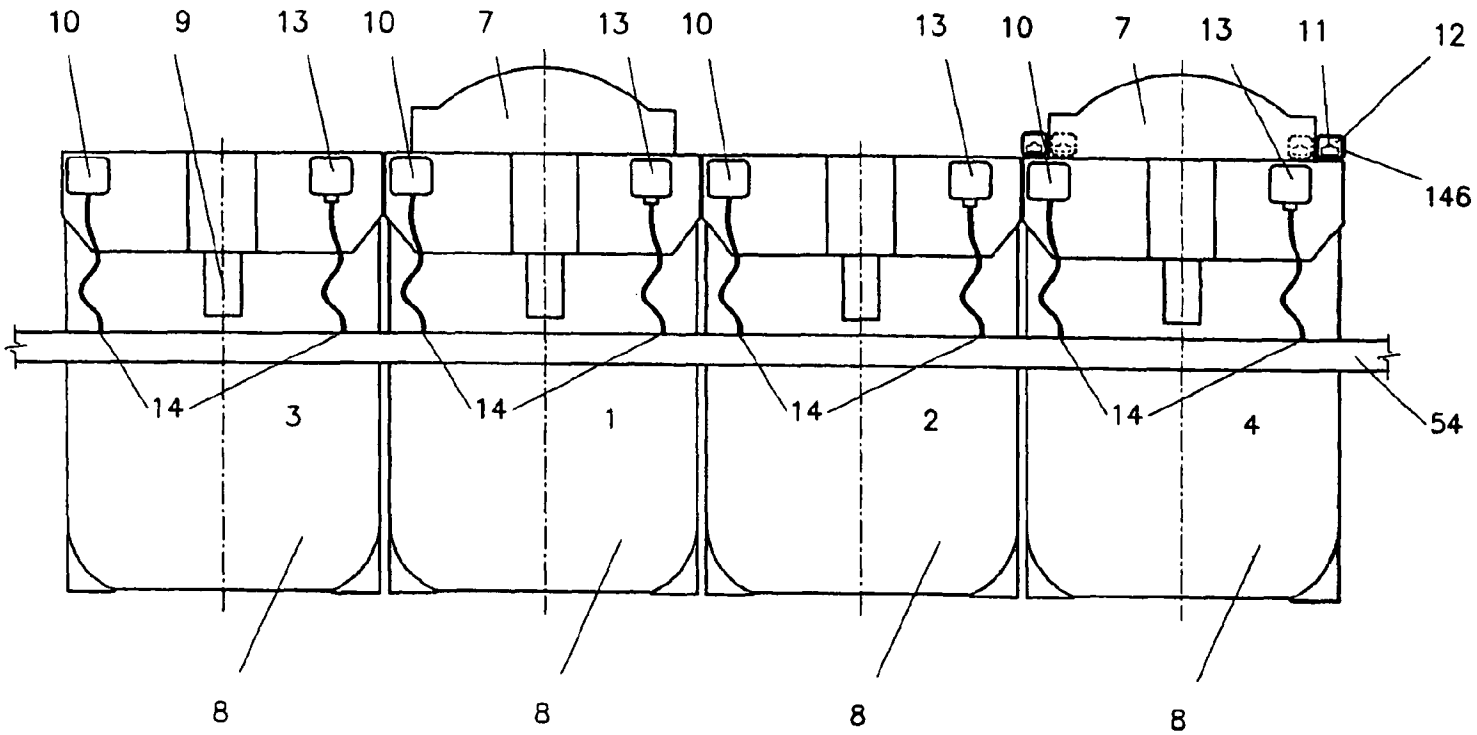
FIG. 3 is a front elevational view corresponding to FIG. 2, but showing in the front wall of the cell at both sides the electrolyte discharge pipe, the electric current distribution boxes for feeding the electronic circuits, the cable distribution boxes that conducts the signals captured to a remote computer center, and multifunctional chambers that lodge sensor circuits in the interior of a dielectric hollow structural shape disposed longitudinally in the lower edges of the hoods.

According to FIGS. 2 and 3 which show a typical bank or 4 electrolytic cells where 2 cells are in intermediate position 1 and 2, and 2 in end position 3, 4, with the electrodes 5 installed in the end cell 3 connected to the respective electrical busbars 6. An intermediate cell 1 and an end cell 4 are shown covered with acid mist collecting hoods 7, typically used in the modern copper electrowinning processes. On the external front wall 8 of said electrolytic cells 1, 2, 3, 4, on both sides of the electrolyte discharges 9 from the electrolytic cells, electrical distribution boxes 10 are shown. These boxes provide the accesses of the electrical wires to each electrolytic cell and lodge current transformer (not shown) to adjust the voltage to suit the electronic circuits 11. Also the multifunctional chambers 12 can be seen formed and protected by a hollow structural shape made of dielectric, anti corrosive, structural polymer composite material, disposed longitudinally in the inferior edges of the hood 7, parallel the electrical busbars 6, and also other possible location alternatives are shown. On the same external front walls 8 on the side opposite to the electrical distribution boxes 10, distribution boxes 13 are shown which collect in each electrolytic cell 1, 2, 3, 4 the electronic signal collected by their sensor circuits 11 from the electrodes 5 and of other variables of the hydrometallurgical electrodeposition process in said cells. To transmit the electronic signals from the cells to the exterior, in this embodiment, the respective cables are provided 14 to carry the signal to a central monitoring, control and remote management system for the operation of the cells in the plant.

Figure 4:
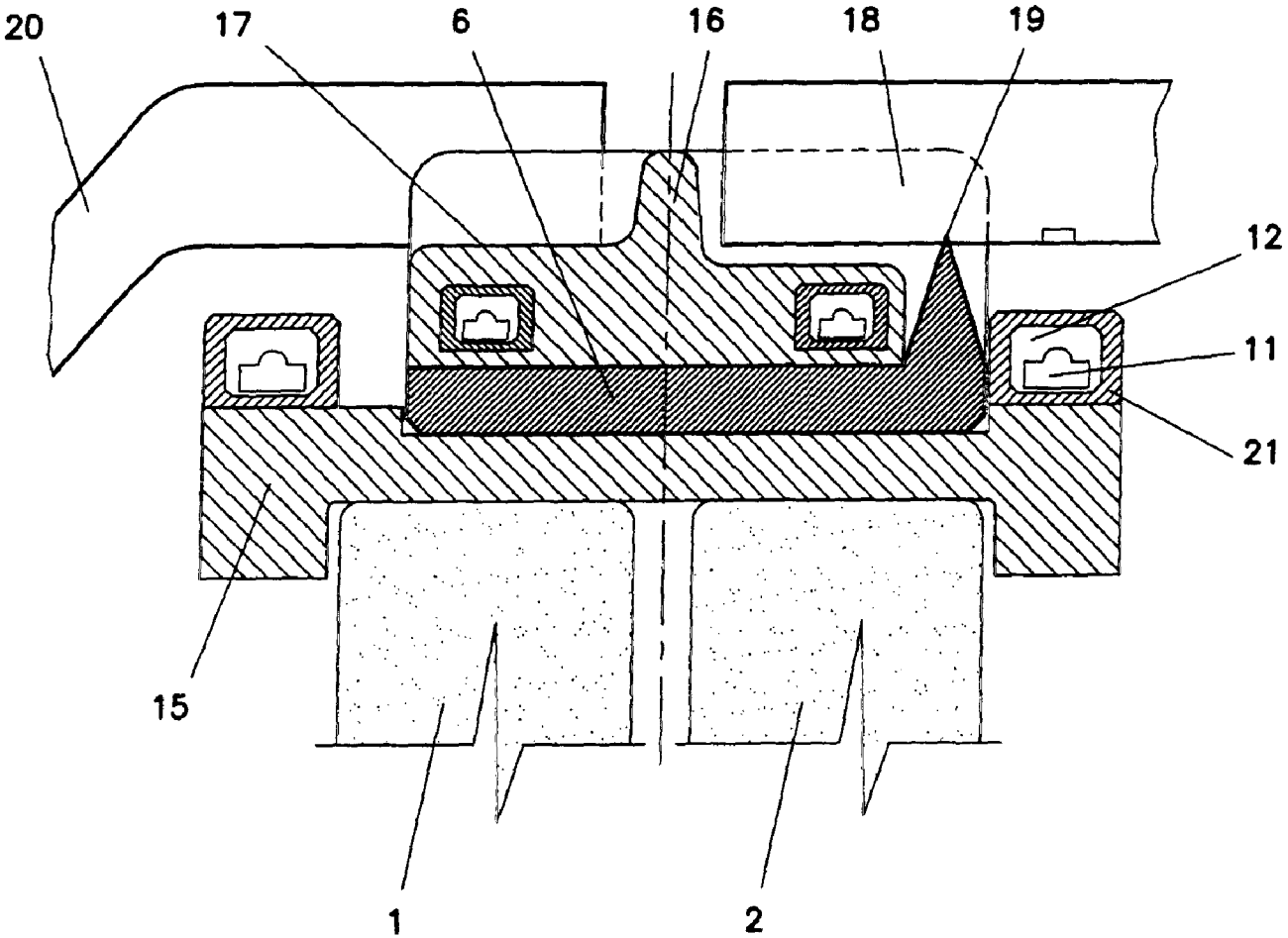
FIG. 4 is a typical cross-section of the longitudinal walls of two adjacent intermediate electrolytic cells, with a support insulator block embracing the wall of the cells on their upper edges, which simultaneously insulates electrically and positions the machined copper electric busbar of rectangular cross section with (or without) protruding points for contact with the electrode, and an electrode spacer electric insulator installed on top the electrical busbar, a direct electrical contact of a cathode hanger bar on the electric busbar, a position of non electrical contact of the anode hanger bar supported on a saddle of the insulator to prevent electrical contact, and the multifunctional cavities for lodging electronic sensor circuits in the support insulator of the electric current busbar.

According to FIG. 4, a typical cross section of the lateral wall of 2 intermediate cells 1, 2 can be seen with the support insulator block 15 molded in one piece of the total length of the cell with polymer composite material, mounted and embracing the upper edge of the walls of cells 1, 2. These insulators blocks support and position the electric busbars 6. In this embodiment, the electrical busbar are of the dog bone type with protruding contacts. For copper electrowinning process, on top of the busbar 6 an electrode spacer electrical insulator 16 has been installed and the cathode hanger bar is shown supported in electrical contact 19 directly with the busbar 6; and also the anode hanger bar 20 is shown in front of said cathode 18 seated on a non contact saddle 17 in this case, monolithic with the electrode spacer electric insulator 16, which maintains electrical insulator on one end of the hanger bar of the anode 20 while the other end contact physically the next busbar 6. In the upper lateral edges of the electrical support insulator 15 that positions the busbar 6 multifunctional cavities 12 of the present invention are provided disposed for the installation and operation of the sensor electronic circuit 11 along the whole length of electric support insulator 15 just below the cathode hanger bars 18 on one side, and on the opposite side, below the anode hanger bars 20, or if convenient, with multifunctional cavities on both edges as shown.

Figure 5:
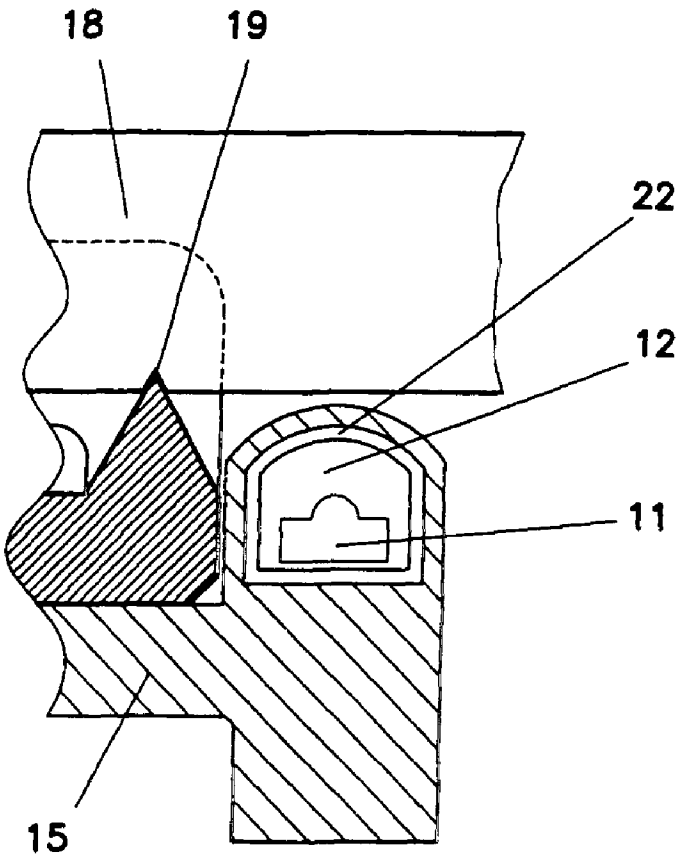
FIG. 5 is an elevational detail view of the section of the FIG. 3 with the multifunctional cavity incorporated monolithically in the body of the support electrical insulator formed inside the dielectric hollow structural shape positioned underneath the hanger bars of the cathodes.
Figure 6:
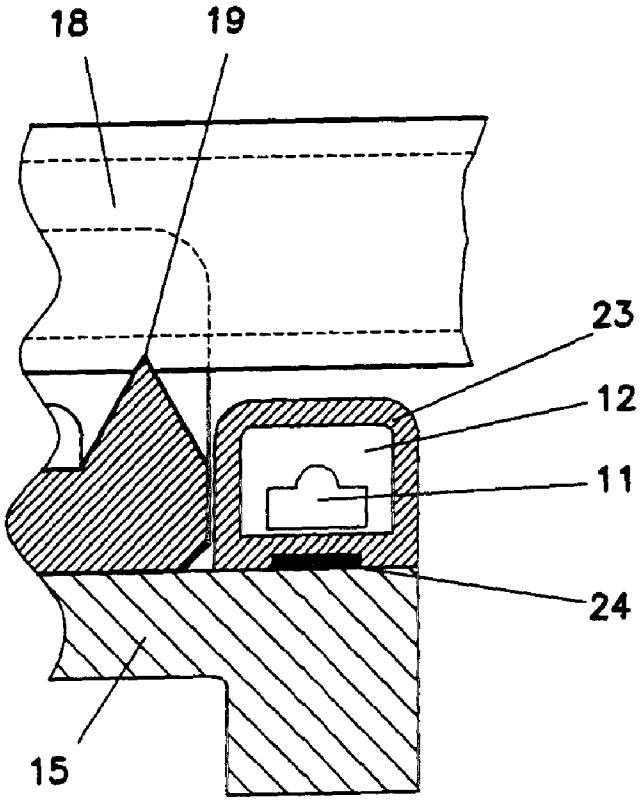
FIG. 6 shows an alternative embodiment with the multifunctional chamber for lodging the electronic sensor circuit formed over the support electric insulator, where such chamber is provided by dielectric hollow structural shape, affixed with an adhesive on the upper lateral flat edge of the support electrical insulator of an existing electrolytic cell.

FIG. 5 shows details of the section of FIG. 4 to characterize an alternative to the multifunctional cavities 12 which it is incorporated monolithically 15 under the cathode hanger bar 18. In the preferred embodiment of the present invention, the multifunctional cavities 2 are monolithically molded along the entire length of insulator 15 within a hollow structural shape 22 manufactured with dielectric structural polymer composite material of characteristics such that enable to comply with its double function of lodging and protecting the electronic circuits 11 from the severe conditions of the immediate surrounding of the cells and of the electrodes, and at the same time, to structurally reinforce the electrical insulator 15 maintaining it straight and without deflections in the horizontal, vertical and transversal axis in all its longitude, to resist sudden temperature increments which are generated during severe electric short circuit episodes in the cell, which given the high amperage of the electric current, have sufficient energy to heat up the hanger bar and the copper busbar very rapidly above 500° C. The thermal shock of such electric short circuit frequently carbonizes insulator 15 if made of rubber or otherwise, a conventional molded insulator made with compositions of typical polymer composite material reinforced with bars of pultruded glass fiber and binding resin, is first deformed and then carbonized. An alternative embodiment of the multifunctional cavities 12 is shown as multifunctional chambers of the electrical insulator 15 in FIG. 6, where the hollow structural shape 23 molded with an anticorrosive, dielectric polymer composite material, has been directly affixed with an adhesive 24 on the plane of the upper perimeter of a support electrical insulator existing in an electrolytic cell.

Figure 7:
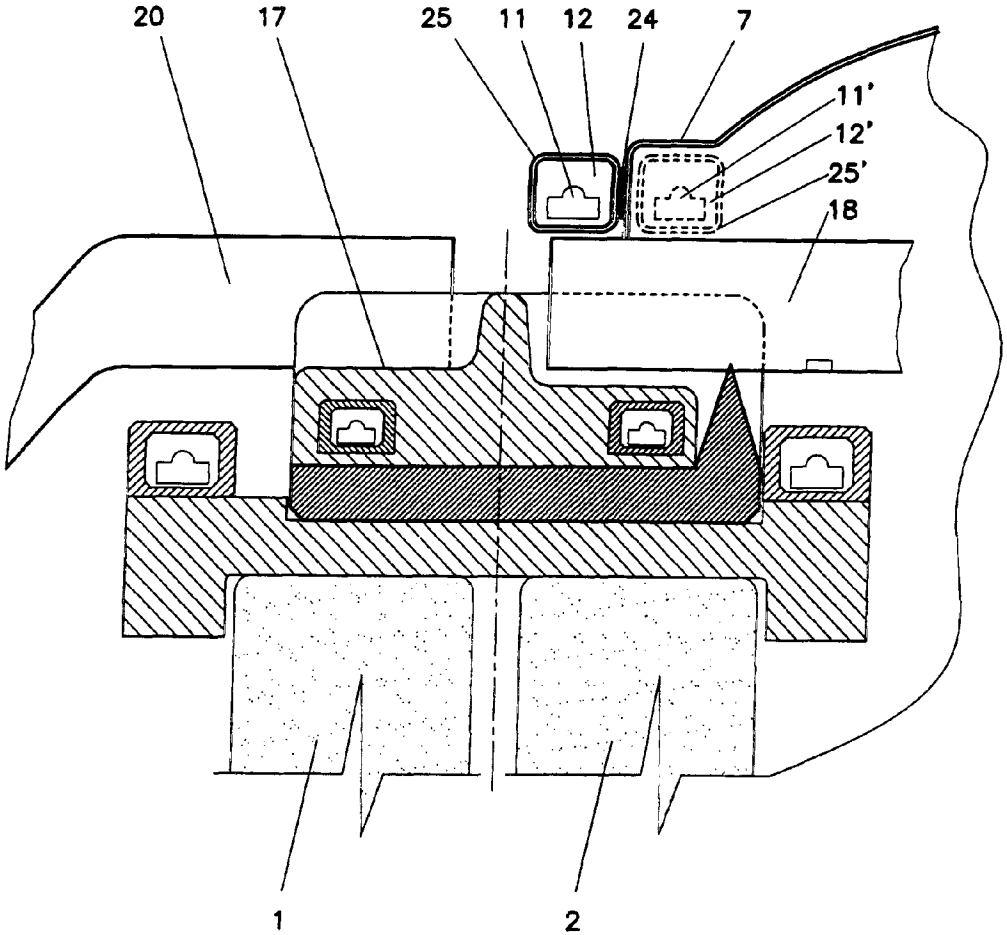
FIG. 7 shows several multifunctional cavities providing lodging and positioning for the respective electronic sensor circuits installed inside the dielectric hollow structural shapes incorporated monolithically inside the support block insulator, the spacer insulator and also, arranged as multifunctional chambers over the hanger bars of cathode and anode, affixed to the lower lateral edges of an acid mist collection hood.

According to FIG. 7, multifunctional cavities 12 are formed as a chambers in the interior of the hollow structural shape 25 of anticorrosive, dielectric polymer composite material is shown, disposed over the hanger bar of cathodes 18 and anodes 20, affixed with adhesive 24 in the interior external lateral edge of the acid mist collector hood 7 installed over electrolytic cells 1, 2. The same Fig. show also and alternative position of the multifunctional chamber 12' formed with hollow structural shape 25' in the inferior inside lateral edge of the collector hood.

Figure 8:
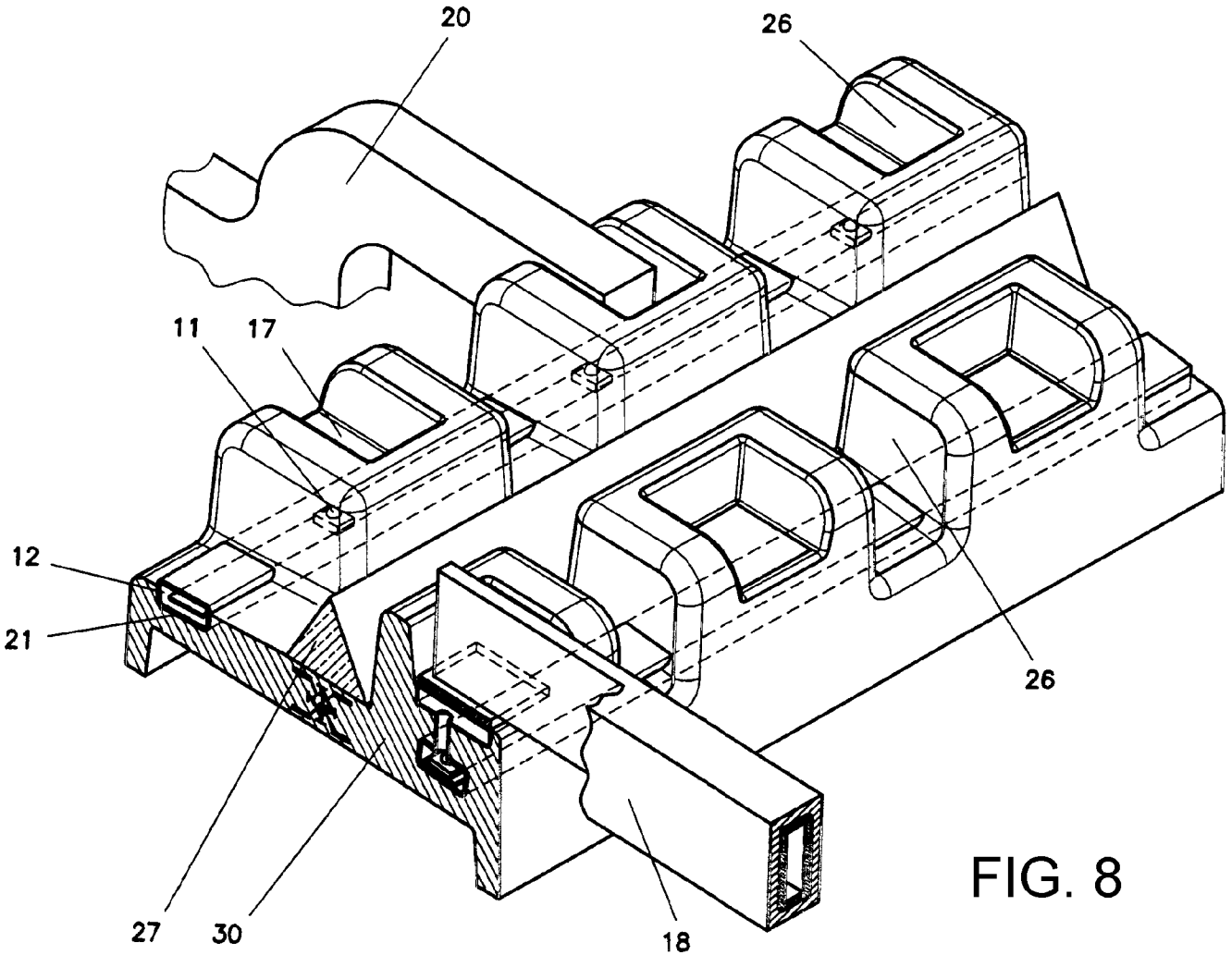
FIG. 8 shows an isometric view of another type of multifunctional electric insulator typically used in copper electrowinning electrolytic cells, which is characterized because the electrical busbar is of triangular cross section (as shown) or circular, supported flat between the parallel rows of non contact insulator saddles, said saddles acting simultaneously as electrode spacers. In the interior of this electrical insulator several multifunctional cavities are provided by different dielectric hollow structural shapes installed monolithically in its interior. In this embodiment, the hollow structural shapes are of rectangular or elliptical cross sections, dielectric and also translucent, and are longitudinally positioned below the rows of saddles for lodging and operating electronic sensor circuits, at a height such over the base supporting the busbar, that enables the translucent hollow structural shape to emerge outside the insulator through the lateral walls of the non contact saddles. The translucent material of the hollow structural shape allows external detection of luminous signals issued from the electronic sensor lodged in the multifunctional cavity inside the insulator.

According to FIG. 8, shown in an isometric view is another type of electrical insulator for electrolytic cells used in copper electrowinning processes, in which the support and electrical insulation of the electric busbar—shown with triangular cross section—form an integral part of the same multifunctional electrical insulator 30 for the electrical insulation and simultaneous spacing of cathode 18 and anode 20 hanger bars. In insulator 30 multifunctional cavities 12 are provided to install the electronic circuits 11 disposed horizontally along one or both lateral edges of electric insulator 30, always disposed under and very near the cathode 18 and anode 20 hanger bars. The multifunctional cavities 12 are provided in this embodiment with hollow structural shape manufactured with dielectric and also translucent polymer composite material 21, installed within the insulator under the rows of non contact insulator saddles 17 and monolithically molded together with insulator 30. The height of placement of the translucent shape 21 in insulator 30 will allow that the upper portion of translucent shape 21 to appear and cross externally the width of the hollow space 26 provided for electric contact of the cathode 18 and anode 20 hanger bars with the electric busbar 27. Such as arrangement allows the visible segment of translucent shape 21 to remain exposed to the exterior of the insulator in such locations of electrical contact, supplying a mean of visual detection of luminous signal issued from the electronic circuit 11 in the multifunctional cavities 12 from the interior of electrical insulator 30.

Figure 9:
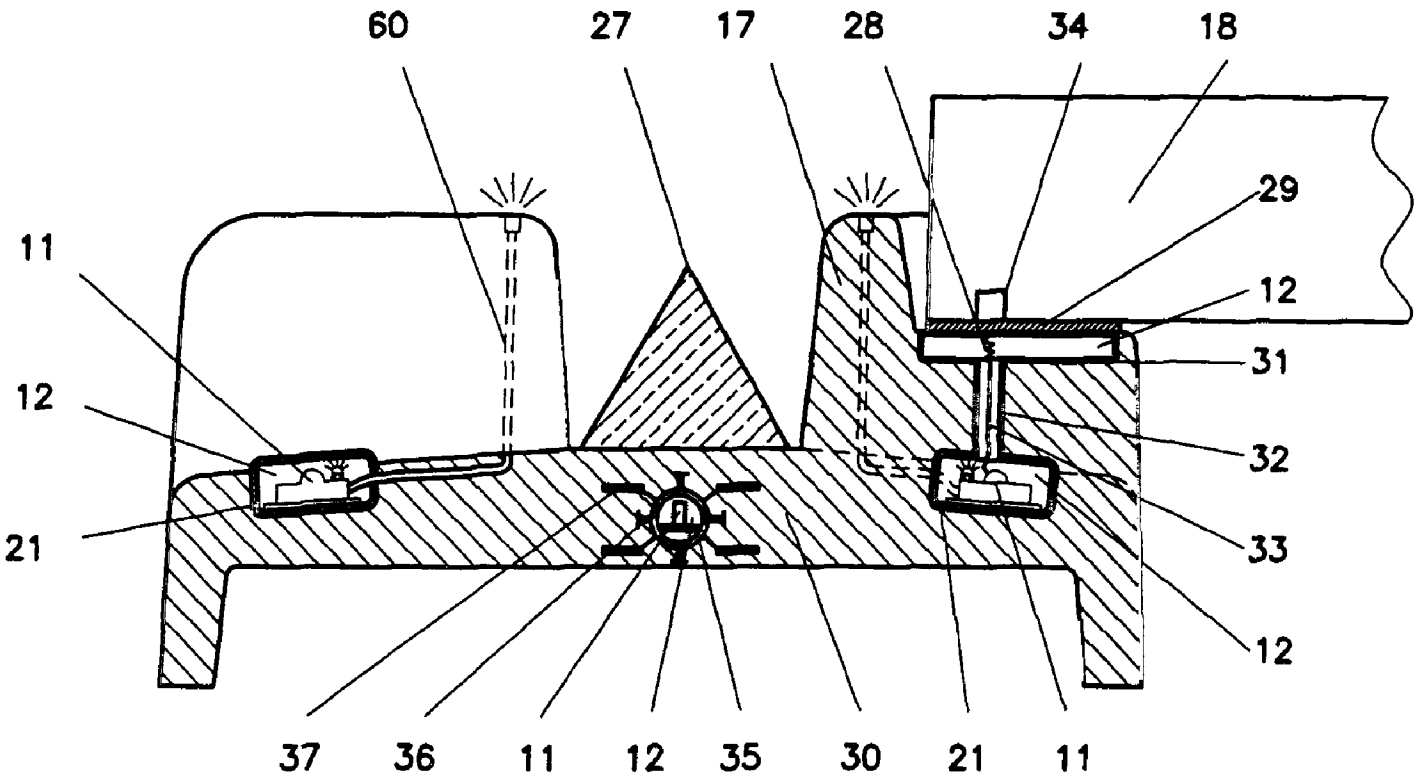
FIG. 9 shows a cross section of the same multifunctional insulator of FIG. 8 supplied with several multifunctional cavities, in this embodiment without translucent hollow structural shapes shown as alternative conducting the luminous signal by means optical fiber to upper edges of the non contact saddles. Also shown are additional multifunctional cavities installed monolithically inside different dielectric hollow structural shapes to measure other additional signals of interest.

FIG. 9 shows a cross sectional elevation of insulator 30 through one non contact insulator saddle 17, illustrating how the end of the cathode hanger bar 18 is supported directly on the upper flat floor of non contact insulator saddle 17 such upper floor surface is covered with pillow 29 of high thermal resistance polymer composite material, preferably polytetraflourethylene (PTFE) to absorb mechanical impact from the electrode, and facilitate the centering of hanger bar in the non contact insulator saddle 17, and cover hollow dielectric structural shape 31 of anticorrosive, high impact resistance polymer composite material, and supplied in sections and of wall thicknesses designed to be capable deforming by bending under the variations in weight of the cathode hanger 18. Shape 31 provides in its interior a multifunctional chamber 12 to install a load cell 28 or equivalent sensor that can measure continuously and in real time the progressive deformation of the upper wall of the shape 31 under the support of the hanger bar on the non contact saddle 17; progressive deformation occurs when in the interior of the electrolytic cell metal is being electrodeposited in said cathode increasing its weight in time (at the rate of about 6 to 10 gr/min). Through a vertical extension 32 of hollow shape 31, another multifunctional cavity 12 is provided which connects 23 electrically and electronically with the multifunctional channel 12 in the longitudinal translucent shape 21 which lodges electronic circuit 11. This circuit 11 which is fed external electrical energy through distribution box 10 supplies to the load cell 28 or equivalent sensor in the non contact insulator saddle 17 in each cathode, the electrical energy necessary for its operation. This same circuit receives electronically from said load cell 28 the signal of load or relief through deformations of shape 31 in one or the other sense according to the instantaneous effective load in the cathode hanger bar 18. Also shown are one or more multifunctional cavities 12 formed with additional hollow shapes of polymer composite material 35 which are encapsulated longitudinally within the volume of insulator 30, and installed in their correct positions within insulator 30 at the time of its molding. Shapes 35 provide multifunctional cavities 12 to install electronic circuits 11 to measure local temperature within insulator 30 with sensor 36. Said sensor 36 discreetly pierces the perimeter of shape 35 at given intervals, as required, on the entire length of electric insulator 30. Equally disposed circumferentially in the material of insulator 30, on the exterior of multifunctional cavities are thin continuous strips of low lineal elongation coefficient material 37 along the length of insulator 30. These strips are connected to their sensing circuits 11 to detect any changes in insulator 30 length, such detection would be indicative of physical interruption or cracks in the material of the insulator 30 as a consequence of overloads from catastrophic impacts or other events in insulator 30 and/or in the non contact saddles.

If the geometry of insulator 30 does not allow installing the shape 21 emerging as shown in FIG. 8, as an alternative fiber optic cables 60 are provided from the translucent multifunctional cavity 12 to make said luminous signals from the sensor circuit 11 in the upper edges of the non contact insulator saddles 17 molded monolithically with the electric insulator 30 to be visible from the outside.

Figure 10:
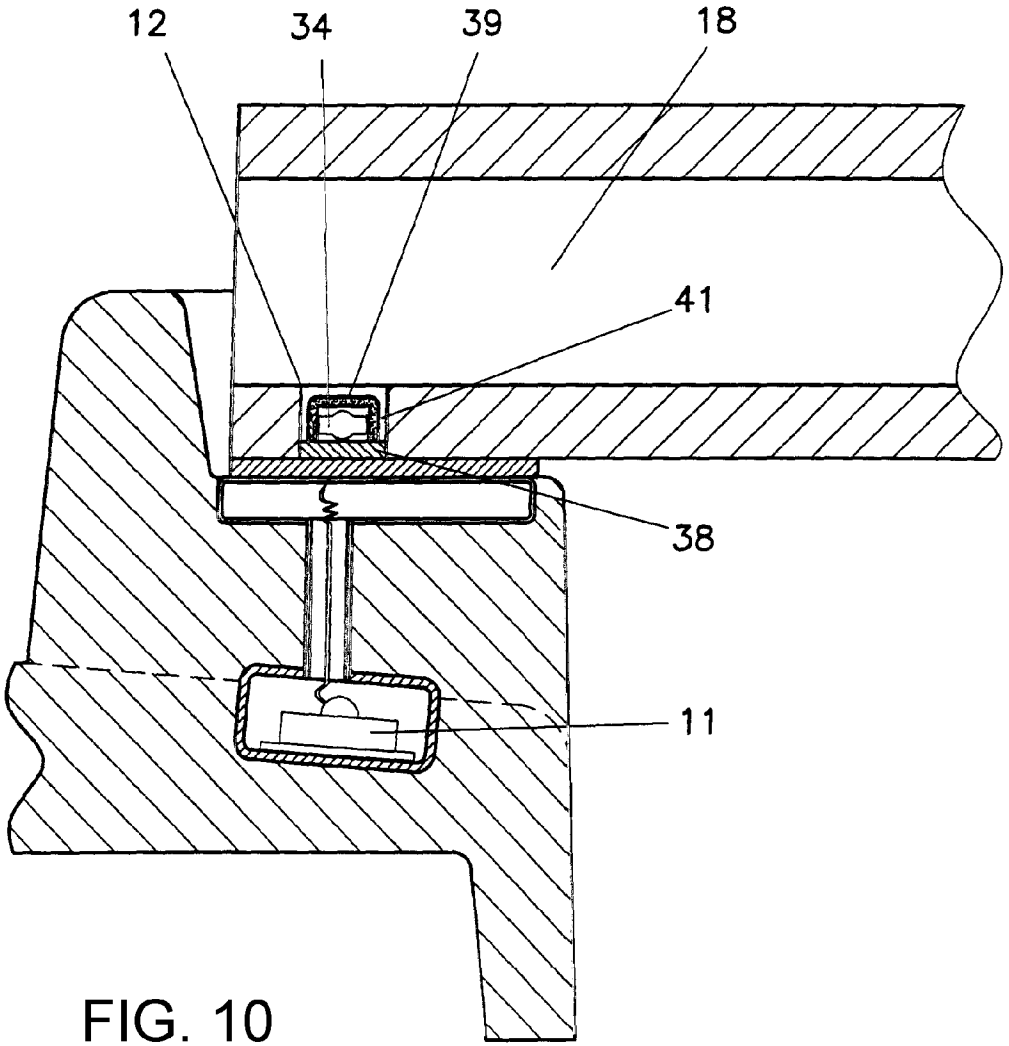
FIG. 10 shows in detail the non contact saddle of FIG. 8 with an arrangement of interconnected multifunctional cavities lodging electronic sensors in the insulator and in the hanger bar of the cathode which in shown resting on the non contact saddle insulator. The multifunctional cavities which are shown with their corresponding sensors, enable, respectively, detecting the instantaneous increment in time of the weight of the cathode hanger bar through its seat in the non contact settle, and also the identification of the cathode at said non contact saddle through programmed signal in its own electronic circuit lodged in its multifunctional cavity in the hanger bar.

In FIG. 10, an electrode with a multifunctional cavity 12 of the present invention is shown located near the end of the cathode 18 and anode 20 hanger bars to implant electronic sensors 34 each one programmed with distinctive electronic variables enabling unequivocal and exclusive identification of the respective electrode where each electronic sensor 34 is implanted, by means of electronic signals emitted and subsequently read from the same circuit 11. The identification of the electrodes enables associating the characteristics of the process of electrodeposition or electro refining in each cathode and anode participating in the cell during the production cycle, specifically two key parameters, which are the sense of flow and the intensity of the instantaneous electric current circulating through each electrode of a basic cell and the corresponding instantaneous weight of metal accumulated on each cathode. This enables monitoring and follow up of their behaviors in real time, in any position and cell in which they are installed in the present or could be installed in successive production cycles. As the temperature of the hanger bars of the cathodes and anodes can rise above 500° C., insulator 39 which forms the multifunctional cavity 12 to lodge the electronic sensor 34 must be of very high thermal resistance, and is supplied made of a structural composite material of high thermal resistance or of dielectric ceramics. In both versions a perimeter air insulting cushion 41 is also provided. The multifunctional cavity 12 can be conveniently communicated with the interior cavity of the hollow cathode hanger bar to maintain the interior temperature of the multifunctional cavity adequate for the operation of sensor 34, and resist short circuit episodes with severe thermal shock. The electric sensor 34 in the dielectric thermal insulator 39, can be also provided to measure the temperature of the hanger bar. In that embodiment, insulator 39 is cylindrical and its base is supplied with a circular lid of dielectric thermal material 38 fitted with pressure to the multifunctional cavity 12 (chamber). This lid 38 allows access to sensor 34 to recover it at the end of the service life of the electrode it identifies, or else to replace it with a new one in case of accidental damage or for any other reason during the useful life of the electrode.

Figure 11:
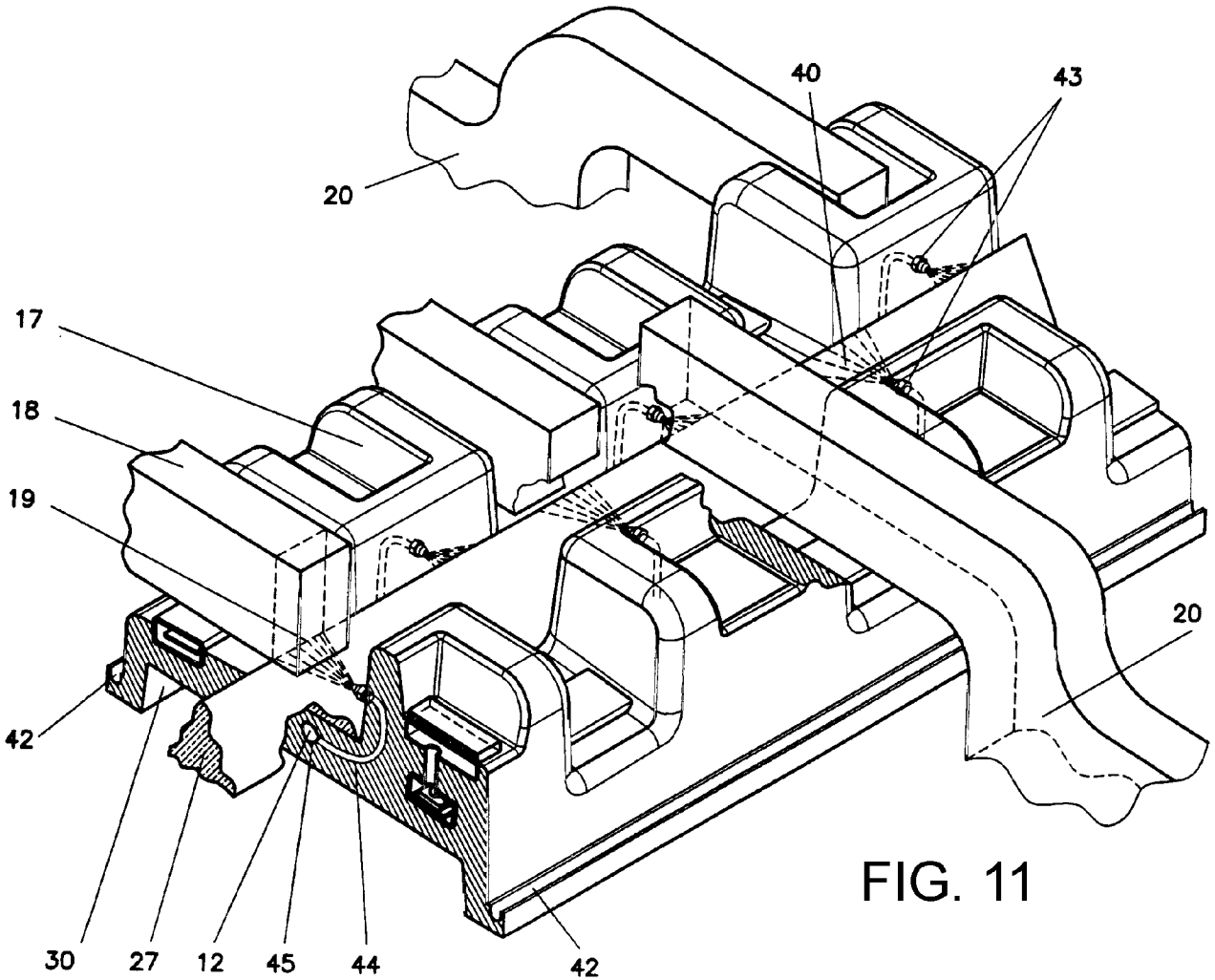
FIG. 11 is another isometric view of FIG. 8 in which multifunctional cavities is provided incorporated within the electrical insulator formed as a pipe to feed a cold fluid at high pressure to several sprinklers installed in the non contact saddles with their discharge orifices oriented to clean the various electrical contacts, and simultaneously, control the temperature in the zone of contact of the electrode hanger bar and the busbar.

FIG. 11 shows an isometric view of another arrangement of the insulator in FIG. 8, highlighting the electric contact zone 19 between the hanger bar of a cathode 18 or anode 20 with the copper 27 electric bus bar. In each non contact saddle insulator 17 facing a contact zone 19 a high water pressure sprinkler is provided 43 aimed to impact, with a fan of cold fluid under pressure 40, the interstice of the physical contact between the lower face of the hanger bar and upper face of the electric bus bar. Each sprinkler 43 is connected to a pipe 44 incorporated in the body of the non contact saddle insulator 17 which is joined with a multifunctional cavity 12 formed with a high pressure tube 45 embedded horizontally along the entire length of insulator 30. This tube 45 is connected to an external source of cold cleaning fluid to act as refrigerant for the contact zone. The thermal sensing elements described work concatenated with an early alert system of electrode short circuits. In effect, the thermal sensors 34 installed in their multifunctional cavities 12 with insulators 39 in the ends of hanger bars of cathodes 18 and anodes 20, upon reaching a given threshold of temperature, the processing unit of the remote monitoring electronic system can activate a pump in the external source of cold fluid refrigerant that elevates the pressure in pipe 45 lodged in the multifunctional cavity 12 above the set nozzle aperture pressure of sprinkler 43. The fluid emerges from the sprinklers to flood the contact zones and lower their temperature, and simultaneously, clean the interstices of electric contact of any dirt or foreign particles that may be causing the local heating. Notwithstanding that the fluid pressure makes all the sprinklers installed on the non contact saddles 17 operate simultaneously on insulator 30, the high temperature signal is displayed with aluminous signal through the translucent structural shapes 21 or fiber optic cables 60 in the position corresponding to the hanger bar that has heated above the set temperature threshold. If the temperature in one or more contacts 19 cannot be controlled with the with the sprinklers at maximum flow of cold refrigerant fluid in a set time, the sensor circuit will signal this condition of sustained thermal non conformity to the central computer monitoring plant 55, activating an alarm indicating potential electrical short circuit in the electrodes involved, with sufficient lead time to initiate a direct intervention in the area of the cell identified with the problem or other action for the effective control the incident, before the temperature rises and transfers in the system to objectionable levels. If the cleaning fluid and/or cold refrigerant should turn out contaminant or detrimental to the electrolyte, the design of insulator 30 provides incorporating longitudinal exhaust gutters 43 slanted towards the ends of insulator 30 to discharge the fluids outside of the containers.

Figure 12:
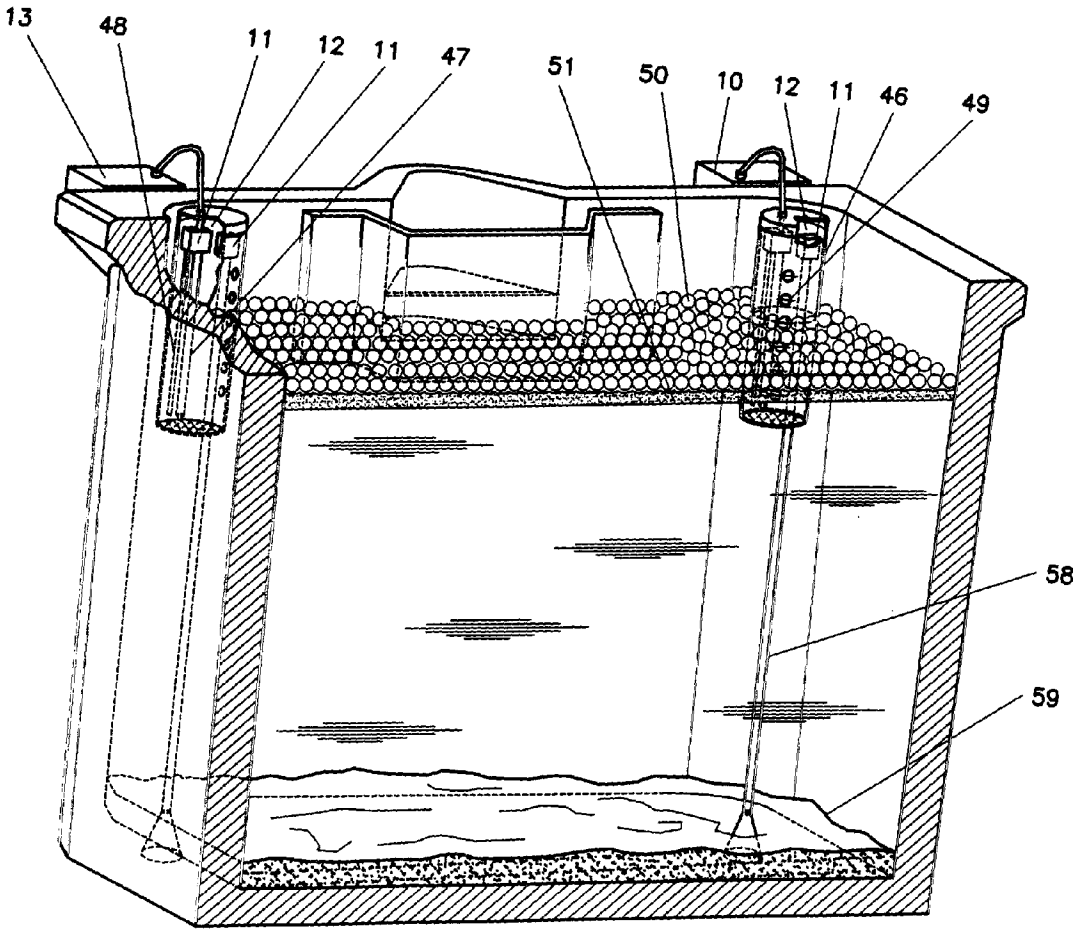
FIG. 12 is an isometric view of a section showing the internal front wall of the container of an industrial electrolytic cell in which devices are provided with multifunctional chambers positioned in the internal corners of the lateral walls and the front walls, formed by vertical dielectric hollow structural tubes, equipped with electronic sensors to measure the temperature of the electrolyte, the height level of the electrolyte, the copper concentration in the electrolyte, the presence and levels of concentration of other contaminant species, presence and layer thickness of entrained organic substances with float in the electrolyte underneath the anti-mist spheres, presence and height level of anodic sludge accumulated on the bottom of the container, etc.

FIG. 12 shows an isometric elevation cut in the container of an intermediate electrolytic cell viewed from the inside of the cell towards the overflow front wall. In the upper corners of the lateral walls with the front wall, multifunctional chambers 12 are provided formed with dielectric, anticorrosive structural polymer composite material tubes 46 with top ends connecting with the ambient covered and lower ends open to the electrolyte, which lodge in their interior sensor circuits 11 with thermocouples sensors 47 that measure the temperature of the electrolyte and level sensors 48 that measure the distance of the level of the electrolyte in those positions from the upper edge of the container, the height of the anodic sludge accumulated on the bottom of container, the copper concentration and sulfuric acid, the presence and concentration of contaminant substances to the electrolyte, and the presence of entrained organic material 51 that floats on the electrolyte underneath the anti mist balls 50. By means of an extension of sensor 58 down the tubes of polymer composite material 46 the height 59 of the anodic sludge accumulated on the container bottom. Holes 49 in the tube allow the entrance of electrolyte and floating inorganic residues 51 to the multifunctional cavity 12 in the interior of the tubes and are measured by the electronic sensors.

The anodic sludge level sensors 58 protrude vertically from the polymer composite material tubes 46 that form the multifunctional cavities 12 in the four corners of the container to the bottom, to measure the height of the anodic sludge. As can be seen in FIG. 12, the ends of the anodic sludge sensors 58 are conical so that the height 59 of sludge from the base to the apex the free surface diameter of the cone diminishes until it disappears. Typically the height of the cone can be made equal to maximum admissible height of anodic sludge. When the sludge reaches that height in at least any two cones of the four installed, an alarm will be activated to indicate "anodic sludge with maximum height" enabling to program the imminent desliming routine of the cell container at the next opportunity.

The variations of level imposed on the electrolyte are indicative of alterations in the set in feed flow of rich electrolyte to the cell, and said flow and corresponding height level inside the cell are determinant of the continuity and quality of the electrodeposition of metal on the cathodes and of their successful management in the production cycle downstream. Excessive electrolyte height extends the height of cathodic surface electrodeposited, diminishing the effective current density applied to the cathode. On the other hand, this over dimension displaces the calibrated initial line of detachment of the metal plates electrodeposited in the stripping machines used for detaching the copper plates from the cathode blank. The variations of the electrolyte height, copper, sulfuric acid and contaminant concentrations, presence of floating organic, uniform electrolyte temperature imposed in all four corners and other variables that may be appropriate to measure and monitor in the container, with respect to their acceptable values imposed in the process, will instantly be indicated at the remote computerized monitor and control center from the electrodes and the cells enabling to take opportunely pertinent corrective actions, as illustrated above with the case of temperatures in the electric contact zones. The excessive height from the maximum admissible set for the anodic sludge accumulated on the bottom of the container signals the opportunity for the next de sliming stop of the electrolytic cell for bottom cleaning.

I claim:

1. A system for monitoring, control and management of a plant where hydrometallurgical processes of electrowinning or electrorefining of non ferrous metals are conducted, which enables measuring the process variables and transforming them into electronic signals, in which said system comprises:

at least one group of electrolytic cells (1, 2, 3, 4) which has a container and electrolyte in its interior;

a plurality of electrodes (5) installed in the interior of each electrolytic cell, alternatively forming anodes and cathodes, for the electrodeposition of a non ferrous metal contained in the electrolyte;

a plurality of electrode hanger bars (5) alternatively forming hanger bars for the anodes (20) and hanger bars for the cathodes (18);

a plurality of support electric insulators (15) located in the upper portion of the lateral walls between two adjacent cells;

a plurality of electric bus bars (6); and a plurality of spacer electric insulators (16) that sit on the electric bus bars (6), each spacer electric insulator (16) having monolithic non contact insulator saddles (17) allowing alternating support of the hanger bars for anodes (20) and of the hanger bars for cathodes (18);

said system being characterized in that each support electric insulator (15) of the plurality of support electric insulators has in the upper lateral edges at least one monolithic multifunctional cavity (12), disposed for the installation and operation of the circuits and/or electronic sensors (11) over the entire length of the support electric insulator (15);

each spacer electric insulator (16) that sits on the electric bus bars (6) has in its body one or more multifunctional cavities (12), disposed for the installation and operation of circuits and/or electronic sensors (11) over the entire length of the spacer electric insulator (16) just under the hanger bars of the cathodes (18) and the hanger bars of the anodes (20); and each electrode hanger bar (5) that forms alternately an anode hanger bar (20) or a cathode hanger bar (18), has a multifunctional cavity (12), disposed for the installation of electronic circuits (34) that allow identifying exclusively each cathode or anode and its relative location in each cell.

2. A system as claimed in claim 1, wherein each cell container is formed by a floor, major lateral walls and minor frontal walls, in which the external minor frontal walls have overflows with discharge pipes for the electrolyte (9), having at each side of said electrolyte discharge pipes (9) connection boxes for external electric current (10).

3. A system as claimed in claim 2, wherein upper corners of one or more lateral walls with the front wall of the cell container of each electrolytic cell are provided with devices that comprise multifunctional chambers (12) formed by tubes of dielectric, anticorrosive, structural polymer composite material (46) covered on their upper end towards the ambient and open on their lower end towards the electrolyte, which lodge in their interior sensor circuits (11) with thermocouple sensors (47) which measure the electrolyte temperature and level sensors (48) which measure the height of the electrolyte level with respect to the upper edge on the container, the copper concentration, sulfuric acid and electrolyte contaminants, and the presence of organic entrained material (51) that floats on the electrolyte under the antiacid mist balls (50), as well as by mean of an extension of an anodic slime sensor (58) of conical end to measure the height (59) of said anodic sludge accumulated on the bottom of the container, in such a way that if the height of the sludge covers at least two cone apex of any two of the four anodic sludge sensors (58) installed, an alarm will be generated in the system to indicate that such a height has been exceeded.

4. A system as claimed in claim 2, wherein the bus bars are provided with a zone of electric contact in their upper face and wherein each electric bus bar (6) is positioned over each support electric insulator (15) and underneath the plurality of electrodes (5) uniformly separated at a set distance by a spacer insulator (16).

5. A system as claimed in claim 1, wherein the bus bars are provided with a zone of electric contact in their upper face and wherein each electric bus bar (6) is positioned over each support electric insulator (15) and underneath the plurality of electrodes (5) uniformly separated at a set distance by a spacer insulator (16).

6. A system as claimed in claim 1, wherein it further comprises a plurality of anti acid mist collection hoods (7), where each anti acid mist collection hood is (7) located over each electrolytic cell.

7. A system as claimed in claim 6, wherein each anti acid mist collection hood (7) located over each electrolytic cell has a multifunctional chamber (12) disposed over the hanger bars for cathodes (18) and hanger bars for anodes (20), affixed on the lateral and external lower edge of the anti acid mist collection hood (7), said multifunctional chamber (12) designed for the installation, arrangement and operation of circuits and electronic sensors (34).

8. A system as claimed in claim 1, wherein said circuits and/or electronic sensors (11, 150) in each multifunctional cavity (12) are connected by a bus of cables (14) for transmission of signals to a control computer (55).

9. A system as claimed in claim 1, wherein data captured by the circuits and/or sensors (11, 150) are sent through an internal network (54) to control computer (55), where said control computer can be accessed via a local, external or public network such as internet (57) from an external computer (56) from any part of the world allowing others to know the state of the electrodeposition process in real time from locations remote to the plant.

10. A system as claimed in claim 1, wherein the multifunctional cavities (12) are formed by tubes of dielectric, anticorrosive, structural polymer composite material (46) and have holes (49) allowing access of electrolyte and floating organic residue (51) to the multifunctional chamber (12) towards the inside of the tubes and being measured by the electronic sensors (11, 34).

11. A system as claimed in claim 1, wherein the support electric insulator (15) and the spacer electric insulator (16) are formed in one piece where support and electric insulation for the bus bar form an integral part of the same multifunctional insulator (30) for the electric insulation and simultaneous spacing of the hanger bars of the cathodes (18) and anodes (20), where in said one piece electric insulator (30) at least one multifunctional cavity (12) is provided to install circuits and/or sensors (11) disposed horizontally lengthwise along one or both lateral edges of said electric insulator (30), located underneath the cathode (18) and anode (20) hanger bars.

12. A system as claimed in claim 11, wherein the multifunctional cavities (12) are formed with hollow structural shapes manufactured of dielectric and translucent polymer composite materials (21), installed inside the insulator under the rows of non contact insulator saddles (17) and molded monolithically together with insulator (30).

13. A system as claimed in claim 12, wherein the height of placement of the translucent shape (21) in insulator (30) allows the upper portion of translucent shape (21) to protrude and transverse externally the width of hollow spaces (26) disposed for contact of the cathode (18) and anode (20) hanger with an electric current bus bar (27).

14. A system as claimed in claim 13, wherein the visible segments of translucent shape (21) are exposed to the exterior of the insulator in said locations for electric contact, in such a way to provide visual detection of luminous signals emitted from the circuits and/or sensors (11) located within multifunctional cavities (12) from the interior of electric insulator (30).

15. A system as claimed in claim 11, wherein the electric insulator (30) has one or more multifunctional cavities (12) formed by additional hollow shapes of polymer composite materials (35) that are encapsulated longitudinally in the volume of insulator (30), and installed at their appropriate positions within insulator (30) at the time of its molding, where circuits and/or sensors (11) are located within the multifunctional cavities (12), destined to measure local temperatures within insulator (30), and where said sensors (36) pierce the perimeter of shape (35) at discrete intervals all along the length of insulator (30).

16. A system as claimed in claim 11, wherein the insulator (30) is provided with thin continuous bars of low lineal elongation materials (37) circumferentially around the exterior of multifunctional cavity (12) all along the length of insulator (30), where such bars are connected to a circuit and/or sensor (11) to detect any change in length over the length of insulator (30), detection that indicates physical interruptions or cracks in the material of insulator (30) as a consequence of overloads from catastrophic impacts or other similar incidents in insulator (30) and/or in its non contact saddles (17).

17. A system as claimed in claim 11, wherein in each non contact insulator saddle (17) facing a contact zone (19), a high pressure water sprinkler (43) is provided to impact, with a fan of cold fluid under pressure, the interstice of physical contact between the lower face of the hanger bar and the upper face of the electric bus bar, where each sprinkler (43) is connected to a pipe (44) incorporated into the body of the non contact insulator saddle (17) and which connects with a multifunctional cavity (12) formed with a high pressure tube (45) embedded horizontally along the entire length of insulator (30), where said tube (45) is connected to an external source of cold cleaning fluid to act as refrigerant for the contact zone, where thermal sensor elements operate concatenated as a system of early alert of short circuits in the electrodes.

18. A system as claimed in claim 17, wherein it includes a pump for the external source of refrigerant fluid that increases the pressure in the tube (45) lodged in the multifunctional cavity or chamber (12) above the opening pressure of sprinkler (43), where the fluid from the sprinklers emerges to flood the contact zones to lower their temperature, and simultaneously, to clean the interstice of electric contact free from any dirt or particle that could be causing the local heat build up.

19. A system as claimed in claim 18, wherein over the electric insulator (30) and under the non contact insulator saddles (17) translucent structural shapes (21) or fiber optic cables (60) are located in the position corresponding to the electrode hanger bar that has been heated over the imposed temperature limit, to indicate with a luminous signal the temperature rise.

20. A system as claimed in claim 18, wherein electric insulator (30) is supplied with longitudinal gutters (43) inclined towards the ends of insulator (30) to discharge fluids outside the container if such cleaning and/or refrigerant fluid proves to be contaminated or undesirable for the electrolyte.

21. A system as claimed in claim 1, wherein a surface of floors of the non contact insulating saddles (17) is covered with a pillow (29) of high thermal resistance polymer composite material, to absorb the shocks and facilitate the centering of the hanger bars in said non contact insulator saddles (17) and cover a hollow dielectric structural shape (31) resistant to impact and acid corrosion, formed of a section and thickness appropriate to deform in flexion under the variations in weight of the cathode hanger bar (18), where the interior of shape (31) is supplied with a multifunctional cavity (12) to install a load cell (28) or equivalent sensor that allows to measure the progressive deformation of the upper wall of the shape (31) under the support of the cathode hanger on the non contact saddle (17), in such a manner as to determine the quantity of metal electrodeposited.

22. A system as claimed in claim 21, wherein in a lower vertical extension (32) of hollow shape (31), a multifunctional cavity (12) is provided which connects electrically and electronically with multifunctional cavity (12) in a translucent longitudinal shape (21) which lodges circuit and/or sensor (11).

23. A system as claimed in claim 22, wherein the circuit and/or sensor (11) is fed with external electric energy through a distribution box (10) that supplies load cell (28) or equivalent sensor in the non contact saddles under each cathode the necessary electric energy for its operation.

24. A system as claimed in claim 23, wherein the circuit and/or sensor (11) receives from said load cells (28), emitted signals of load or relief through deformations of shape (31) in one or other sense according to the effective instantaneous loads on the cathode hanger bars (18).

25. A system as claimed in claim 1, wherein one electrode with a multifunctional cavity (12) is located near the end of the hanger bar of the cathode (18) and of the anode (20) to implant electronic sensors (34) each previously programmed with its own distinctive electronic variables that allow identifying, unequivocally and exclusively, the electrode in which each electronic sensor (34) is implanted, by means of signals emitted and then read from circuit (11).

26. A system as claimed in claim 25, wherein the hanger bar has an insulator (39) formed by a multifunctional cavity (12) of high thermal resistance to lodge sensor (34), said hanger bar having also a perimeter insulating air cushion (41) where said multifunctional cavity (12) is communicated with the hollow interior of cathode hanger bar (18) to maintain the interior temperature of the multifunctional cavity adequate for the operation of sensor (34) and resist short circuit episodes with severe thermal shocks.

27. A system as claimed in claim 26, wherein the sensor (34) is in a dielectric thermal insulator (39), and in addition may be disposed to measure the temperature of the hanger bar, where said insulator (39) is of cylindrical type, and supplied in its base with a circular lid of dielectric thermal material (38), affixed with pressure fit to the multifunctional cavity (chamber) (12), and where said lid (38) enables access to sensor (34) to recover it at the end of the service life of the electrode it identifies, or for replacement by a new one in case of accidental damage or for any other reason during the service life of the electrode.

28. A system as claimed in claim 1, wherein alternately the acid mist collection hood (7) located over each electrolytic cell is provided with a multifunctional cavity (12) disposed in the lower and exterior lateral edge of said acid mist collection hood (7).

29. A system as claimed in claim 1, wherein the electric bus bars (6) are of the dog bone type with protruding electrical contacts or flat without protrusions.

30. A system as claimed in claim 1, wherein the electric bus bars (6) are of triangular or cylindrical cross sections.

31. A support electric insulator to be used in a system for monitoring, control and management of a plant where hydrometallurgical processes of electrowinning or electrorefining of non ferrous metals are conducted that enables to measure process variables and transform them into electronic signals, of the type that is located on the upper portion of lateral walls between two contiguous cells of said plant, characterized in that it provides in the upper lateral edges one or two multifunctional cavities (12) separated by the electric bus bar (6), where said multifunctional cavities (12) are disposed for the installation and operation of circuits and/or electronic sensors (11) along the entire length of support electric insulator (15) just underneath the hanger bars of the cathodes (18) on one side, and the hanger bars of the anodes (20) on the other side.

32. A spacer electric insulator to be used in a system for monitoring, control and management of a plant where hydrometallurgical processes of electrowinning or electrorefining of non ferrous metals are conducted that enables to measure process variables and transform them into electronic signals, of the type that sits on electric bus bars (6), and comprises a plurality of spacer electric insulators, where each spacer electric insulator (16) having non contact monolithic insulator saddles (17) allowing to alternately insulate anode hanger bars (20) and cathode hanger bars (18), characterized in that it provides in the upper lateral edges one or more multifunctional cavities (12) disposed for the installation and operation of circuits and electronics sensors (11) along the entire length of spacer electric insulator (16) just underneath the hanger bars of the cathodes (18) and the hanger bars of the anodes (20).

33. A multifunctional electric insulator for support of an electric bus bar and for electrode spacing formed monolithically as an electric bus bar support insulator and a spacer electric insulator, for electric insulation and simultaneous spacing of the hanger bars of the cathodes (18) and anodes (20), where said multifunctional electric insulator is used in a system for monitoring, control and management of a plant where hydrometallurgical processes of electrowinning or electrorefining of non ferrous metals are conducted that enables to sense process variables and transform them into electronic signals characterized in that multifunctional cavities (12) are provided for installing electronic circuits (11) in the multifunctional electric insulator (30) horizontally all along one or both lateral edges of said electric insulator (30), underneath the hanger bars for cathodes (18) and anodes (20), where said multifunctional cavities (12) are formed with hollow, translucent structural shapes (17), installed within the insulator under the non contact insulator saddles (17) and molded monolithically together with the insulator (30).

34. A multifunctional electric insulator for support and spacing as claimed in claim 33, wherein the surface of the floor of the non contact insulator saddles (17) is covered with a pillow (29) of a polymer composite material of high thermal resistance, to absorb impacts and facilitate the centering of hangers bars in said non contact insulator saddles (17) and cover a hollow dielectric structural shape (31) resistant to impact and to acid corrosion, formed with such section and thicknesses that can deform in flexion by variations of weight of the cathode hanger bar (18), where the interior of shape (31) is provided with a multifunctional cavity (12) for installing a load cell (28) or equivalent sensor that enables measuring the progressive deformation of the floor over the upper wall of shape (31) under the support of the cathode hanger bar on the non contact saddle (17), in such a manner to determine the quantity of electrodeposited metal.

35. A multifunctional electric insulator for support and spacing as claimed in claim 34, wherein a vertical inferior extension (32) of hollow shape (31) and a multifunctional cavity (12) is provided connecting electrically and electronically with multifunctional cavity (12) in longitudinal translucent shape (21) which lodges circuit and/or sensor (11).

36. A multifunctional electric insulator for support and spacing as claimed in claim 35, wherein a circuit and/or sensor (11) is connected to external electric current through a distribution box (10) and provides to the load cell (28) in the non contact saddle (17) in each cathode electric current needed for its operation.

37. A multifunctional electric insulator for support and spacing as claimed in claim 36, wherein the circuit and/or sensor (11) receives from said load cells (28) signals of load or relief from the deformations of shape (31) in one or the opposite sense, according to the instantaneous effective loads in the hanger bars of the cathodes (18).

38. A multifunctional electric insulator for support and spacing as claimed in claim 33, wherein the electric insulator (30) is provided with one or more additional multifunctional cavities (12) formed with hollow shapes of dielectric polymer composite materials (35) that are encapsulated longitudinally in the volume of insulator (30) upon its molding, where such multifunctional cavities lodge circuits and/or sensors (11) destined to measure local temperatures within insulator (30) with sensors (36), and where such sensors (36) pierce the perimeter of shapes (35) at discrete intervals all along the length of electric insulator (30).

39. A multifunctional electric insulator for support and spacing as claimed in claim 33, wherein each non contact insulator saddle (17) facing a contact zone (19) is provided with a high pressure sprinkler (43) directed to impact with a fan of pressurized cold fluid, the interstice of physical contact between the lower face of the hanger bar and the upper face of the electric bus bar, where each sprinkler (43) is connected to a pipe (44) incorporated in the body of the non contact insulator saddle (17) and connecting to with a multifunctional cavity (12) formed by a high pressure tube (45) embedded horizontally along the length of insulator (30), where said tube (45) connects to an outside source of cold cleaning fluid to act as refrigerant for the contact zones, where such thermal sensor elements operate concatenated together as a system of early alert of short circuits in the electrodes.

40. A multifunctional electric insulator for support and spacing as claimed in claim 33, wherein the electric insulator (30) and under the non contact insulator saddles (17) translucent structural shapes (21) or fiber optic cables (60) are provided in the position corresponding to the electrode that has overheated above the limit temperature set, to indicate with a luminous signal the increment of temperature.

41. A multifunctional electric insulator for support and spacing as claimed in claim 33, wherein electric insulator (30) is provided with longitudinal gutters (43) inclined towards the ends of insulator (30) to discharge the cold fluids outside the container, if said cleaning and/or refrigerant fluid proves to be contaminant or undesirable for the electrolyte.

42. A multifunctional electric insulator for support and spacing as claimed in claim 33, wherein the surface of a floor of the non contact insulator saddles (17) is covered with a pillow (29) of a polymer composite material of high thermal resistance, to absorb impacts and facilitate the centering of hangers bars in said non contact insulator saddles (17) and cover a hollow dielectric structural shape (31) resistant to impact and to acid corrosion, formed with such section and thicknesses that can deform in flexion by variations of weight of the cathode hanger bar (18), where the interior of shape (31) is provided with a multifunctional cavity (12) for installing a load cell (28) or equivalent sensor that enables measuring the progressive deformation of a floor over an upper wall of shape (31) under the support of the cathode hanger bar on the non contact saddle (17), in such a manner to determine the quantity of electrodeposited metal.

43. A multifunctional bus bar support and electrode spacer electrical insulator comprising multifunctional cavities, wherein the multifunctional cavities (12) are formed with hollow structural shapes made of dielectric and also translucent polymer composite materials (21), installed inside the insulator under the rows of non contact insulator saddles (17) and molded monolithically together with the insulator (30).

44. A multifunctional bus bar support and electrode spacer electrical insulator, as claimed in claim 43, wherein the height of the position of the translucent shape (21) in the insulator (30) allows the upper portion of the body of translucent shape (21) to protrude and transverse externally hollow spaces (26) between non contact saddles, said hollow spaces disposed for the contacts of cathode hanger bars (18) and anodes (20) with the electrical bus bar (27).

45. A multifunctional bus bar support and electrode spacer electrical insulator, as claimed in claim 43, wherein the visible segments of the translucent shape (21) are exposed to the exterior of the insulator in said locations disposed for electric contact, in such a way to provide illuminated spaces by luminous signals emitted from the circuits and/or sensors (11) located inside the multifunctional cavities (12) for visual detection of said signals from the exterior of electric insulator (30).

46. A multifunctional bus bar support and electrode spacer electrical insulator, as claimed in claim 43, wherein visible segments of the translucent shape (21) are exposed to the exterior of the insulator in locations disposed for electric contact, in such a way to provide illuminated spaces by luminous signals emitted from circuits and/or sensors (11) located inside the multifunctional cavities (12) for visual detection of said signals from the exterior of electric insulator (30).

47. A multifunctional bus bar support and electrode spacer electrical insulator, as claimed in claim 43, wherein the height of the position of the translucent shape (21) in the insulator (30) allows the upper portion of the body of translucent shape (21) to protrude and transverse externally hollow spaces (26) between non contact saddles, said hollow spaces disposed for contacts of cathode hanger bars (18) and anodes (20) with electrical bus bars (27).

48. An electrode hanger bar (5) that allows forming indistinctly hanger bars for anodes (20) and hanger bars for cathodes (18) to be used in a system to monitor, control and management of a plant where hydrometallurgical processes of electrowinning or electrorefining of non ferrous metals are conducted, that enables to sense process variables and transform them into electronic signals comprising a multifunctional cavity (12), where the multifunctional cavity is provided near the end of the hanger bars for cathodes (18) or hanger bars for anodes (20), disposed and suitable for the installation of electronic sensors (34).

49. An electrode hanger bar as claimed in claim 48, wherein an electrode with a multifunctional cavity (12) is located near the end of the hanger bar for cathodes (18) and anodes (20) to implant electronic sensors (34) each one previously programmed with distinctive exclusive electronic variables, that allow identifying unequivocally the electrode to which each electronic sensor (34) is implanted by means of signals emitted and then read from a circuit (11).

50. An electrode hanger bar as claimed in claim 49, wherein the hanger bar possesses a thermal dielectric insulator (39) formed by a multifunctional cavity (12) to lodge sensor (34) of high thermal resistance, said hanger bar possessing in addition an insulating perimeter air cushion (41) where the multifunctional cavity (12) is communicated with the hollow interior of the cathode hanger bar to maintain the internal temperature of the multifunctional cavity appropriate for the operation of sensor (34) and resist short circuit episodes with severe thermal shock.

51. An electrode hanger bar as claimed in claim 50, wherein sensor (34) in thermal dielectric insulator (39) also may be supplied to measure the hanger bar temperature, where said insulator (39) is cylindrical and its base supplied with a circular lid of thermal dielectric material (38) affixed with pressure fit to the multifunctional cavity (chamber) (12), where such lid (38) allows access to sensor (34) to recover it at the end of service life of the electrode it identifies, or for its replacement by a new one in case of accidental damage or by any other reason during the service life of the electrode.

52. An acid mist collection hood (7) for covering an electrolytic cell, in which said acid mist collection hood is used in a system to monitor, control and management of a plant where hydrometallurgical processes of electrowinning or electrorefining of non ferrous metals are conducted that enables to measure process variables and transform them into electronic signals characterized in comprising a multifunctional cavity (12) disposed over hanger bars for cathodes (18) and hanger bars for anodes (20) affixed on to a lower lateral and exterior edge of said acid mist collection hood (7), said multifunctional cavity (12) designed for the installation and operation of electronic circuit sensors (34).

53. An acid mist collection hood as claimed in claim 52, wherein the acid mist collection hood (7) located over each electrolytic cell possess one multifunctional chamber (12) disposed along the lateral inferior and external edge of said acid mist collection hood (7).

54. A device for measuring temperature, electrolyte height, copper concentration in solution, sulfuric acid and contaminants of the electrolyte, as well presence of entrained organic material that floats on the electrolyte, presence and height of anodic sludge on the bottom of containers, where said device is used in a system to monitor, control and management of a plant where hydrometallurgical processes of electrowinning or electrorefining of non ferrous metals are conducted that enables to measure process variables and transform them into electronic signals characterized in that said device is located in the upper corners of lateral and front walls of each electrolytic cell container within multifunctional chambers (12) formed by tubes of dielectric anti corrosive polymer composite material (46) covered in its upper end towards ambient and open in their lower ends towards the electrolyte, which lodge in interior sensors (11) equipped with thermocouples (47) to measure electrolyte temperature and with altimeters (48) to measure the level of the electrolyte with respect to an upper edge of the container and the presence of organic entrained material (51) which floats on electrolyte under anti acid mist balls (50), and also an extension of an anodic sludge sensor (58) to measure the height (59) of said anodic sludge accumulated on the bottom of the container.

55. A device as claimed in claim 54, wherein the multifunctional chambers (12) formed by tubes of dielectric anti corrosive polymer composite material (46) are supplied with holes (49) which allow entrance of electrolyte and floating organic residue (51) to the multifunctional cavity (chamber) (12) towards the interior of the tubes and allow their measurement by the electronic sensors (11, 34).

56. A device as claimed in claim 55, wherein the anodic sludge sensors (58) protrude vertically down from the polymer composite material tubes (46) which form the multifunctional chambers (12) in the four corners of the container to its bottom, to measure the height (59) of the anodic sludge.

57. A device as claimed in claim 54, wherein the anodic sludge sensors (58) protrude vertically down from the polymer composite material tubes (46) which form the multifunctional chambers (12) in the four corners of the container to its bottom, to measure the height (59) of the anodic sludge.

58. A device as claimed in claim 57, wherein the ends of the anodic sludge sensors (58) are conical, and as the height (59) of the sludge increases covering from the base to the apex, the free diameter of the cone diminishes until it disappears under the sludge.

59. A device as claimed in claim 58, wherein the height of the cone which can be made to represent the maximum admissible height (59) of anodic sludge.

* * * * *